US012366140B1

(12) United States Patent
Krauss

(10) Patent No.: US 12,366,140 B1
(45) Date of Patent: Jul. 22, 2025

(54) CONTROLLED OPENING OF A VALVE IN AN APPARATUS FOR PREVENTING DOWNHOLE SURGES

(71) Applicant: Halliburton Energy Services, Inc., Houston, TX (US)

(72) Inventor: Christiaan Dennis Krauss, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/598,513

(22) Filed: Mar. 7, 2024

(51) Int. Cl.

| | |
|---|---|
| ***E21B 43/10*** | (2006.01) |
| ***E21B 17/20*** | (2006.01) |
| ***E21B 34/06*** | (2006.01) |
| ***E21B 34/10*** | (2006.01) |
| ***E21B 34/14*** | (2006.01) |

(52) U.S. Cl.
CPC ..... *E21B 43/10* (2013.01); *E21B 17/20* (2013.01); *E21B 34/063* (2013.01); *E21B 34/105* (2013.01); *E21B 34/14* (2013.01); *E21B 2200/04* (2020.05)

(58) Field of Classification Search
CPC ..... E21B 43/10; E21B 17/20; E21B 34/063; E21B 34/105; E21B 34/14; E21B 2200/04
See application file for complete search history.

(56) References Cited

U.S. PATENT DOCUMENTS 4,193,450 A * 3/1980 Fisher, Jr. ..... E21B 23/10 166/324
4,609,005 A * 9/1986 Upchurch ..... F16K 13/04 137/71
4,627,492 A * 12/1986 MacLaughlin ..... E21B 49/001 166/250.08
4,986,361 A * 1/1991 Mueller ..... E21B 23/08 166/381
5,193,621 A 3/1993 Manke et al.
5,819,853 A * 10/1998 Patel ..... E21B 34/063 166/373
5,950,733 A 9/1999 Patel
6,634,428 B2 10/2003 Krauss et al.
8,393,389 B2 3/2013 Brisco et al.
(Continued)

OTHER PUBLICATIONS

Kevin Trahan et al., A proven Liner Floatation Method For Extended-Reach Waves, IADC/SPE 59213, Mar./Apr. 2000. pp. 1-7.
(Continued)

*Primary Examiner* — James G Sayre
(74) *Attorney, Agent, or Firm* — Conley Rose, P.C.; Rodney B. Carroll

(57) ABSTRACT

An exemplary apparatus for use in a tubular string may include piston, a metering device, and a body having a longitudinal bore extending therethrough. When a valve of the apparatus is in an open position, the valve may seal the bore, and when the valve is in a closed position, the valve may allow fluid to flow through the bore. A fluid chamber may be formed between the body and the piston. A pressure activated mechanism may open fluid communication between the fluid chamber and the metering device, in response to pressure in the bore exceeding a threshold, to allow fluid in the fluid chamber to exit through the metering device. The piston may translate from a first position to a second position, as fluid exits the fluid chamber through the metering device, to drive the valve from the closed position to the open position.

20 Claims, 16 Drawing Sheets

(56) References Cited

U.S. PATENT DOCUMENTS

| | | | | |
|---|---|---|---|---|
| 10,519,753 | B2 | 12/2019 | Dedman et al. | |
| 10,883,314 | B2 | 1/2021 | Getzlaf et al. | |
| 11,098,556 | B2 | 8/2021 | Frazier | |
| 11,180,958 | B2 | 11/2021 | Getzlaf et al. | |
| 2008/0271883 | A1* | 11/2008 | Barton | E21B 34/063 166/317 |
| 2009/0272544 | A1 | 11/2009 | Giroux et al. | |
| 2014/0000906 | A1* | 1/2014 | Williamson | E21B 43/10 166/212 |
| 2014/0008083 | A1 | 1/2014 | Ring et al. | |
| 2014/0034310 | A1 | 2/2014 | Andersen | |
| 2015/0361762 | A1* | 12/2015 | Ringgenberg | E21B 34/10 166/373 |
| 2016/0333658 | A1* | 11/2016 | Keshishian | E21B 33/165 |
| 2018/0080308 | A1 | 3/2018 | Dedman et al. | |
| 2021/0363843 | A1 | 11/2021 | Stephenson et al. | |
| 2024/0191811 | A1* | 6/2024 | Riseth | E21B 3/022 |

OTHER PUBLICATIONS

Miguel O. Mota et al., Near Field Developments with an Upgraded Brown-Field Platform Rig: Sharing the Learning from a Three-Well Extended Reach Drilling (ERD) Program, pp. 1-13. IADC/SPE 151193 Mar. 6-8, 2012, San Diego CA.

German Munoz et al., Pushing the Limit for Extended Reach Drilling: Delivering the Longest Well in Saudi Arabia and the Worldwide Deepest 6 1/8-in. Section, pp. 1-22. SPE-177816-MS, Nov. 9-12, 2015, Abu Dhabi, UAE.

Ahmed Ai Haji et al., Overcoming Challenging Openhole Conditions Using Flotation Approach, pp. 1-10. IPTC-22822-EA, Mar. 1-3, 2023, Bangkok, Thailand.

Zhihua Wang et al., A Novel Approach to Liner Floatation Extends the Standard Well Reach in a North Sea Field Development. pp. 1-8. IADC/SPE 87187, Mar. 2-4, 2004.

Johan Eck-Olsen et al., Floatation of 103/4-in. Liner—A Method Used to Reach Beyond 10 km, pp. 1-9. SPE/IADC 105839, Feb. 22-24, 2007, Amsterdam, The Netherlands.

Foreign Communication from Related Application—International Search Report and Written Opinion of the International Searching Authority, International Application No. PCT/US2025/012083, dated May 13, 2025, 13 pages.

* cited by examiner

CONTROLLED OPENING OF A VALVE IN AN APPARATUS FOR PREVENTING DOWNHOLE SURGES

CROSS-REFERENCE TO RELATED APPLICATIONS

None.

STATEMENT REGARDING FEDERALLY SPONSORED RESEARCH OR DEVELOPMENT

Not applicable.

FIELD

The present disclosure relates generally to controlled opening of a valve in a floatation sub. More particularly, the present disclosure relates to, allowing fluid to flow through a floatation sub valve in a controlled manner, for example, to prevent large pressure drops and/or downhole surges.

BACKGROUND

A liner in a wellbore is a casing string that does not extend back to the wellhead but is hung from another casing string or liner inside the well. Essentially, it may be a long tube made of steel or other materials that can be inserted into a portion of the length the wellbore. Concrete may affix the liner in place within the wellbore. Liners may be used for various purposes in the construction and completion of oil and gas wells.

Floating a liner refers to a technique that may be used during the installation of a liner in a wellbore where the liner is partially supported by buoyancy. This may be achieved by filling the liner with a fluid that is lighter than the drilling mud in the wellbore, reducing its effective weight and making it easier to handle and run into the well. One benefit of floating a liner in a horizontal well may be the significant reduction in friction between the liner and the wellbore. As an example, horizontal sections can extend for up to three miles or more, and in general the liner becomes harder to push the longer it is.

Floating a liner in a horizontal section may for example involve partially filling casing and/or liner strings with air or a light fluid, and providing a heavier fluid atop to aid in getting the string to bottom. The lighter fluid or air in the lower section of the string may be isolated from the heavier fluid in the upper section of the string, for example using a valve. For example, to get the string to the required setting depth, a fluid separation sub may be run in the string to allow the section above the separation sub to be filled with heavier fluid to aid getting the string to the required setting depth. When the string is at its required setting depth, a valve in the separation sub may be opened up, allowing the heavier fluid above the separation sub to enter the section below the separation sub. However, conventional subs can have the disadvantage of transitioning rapidly from a completely closed to a fully open position. As a result, an extremely fast and uncontrolled drop in pressure of the upper fluid section may be observed. Also, due to the velocity of the heavier fluid above the device, a high pressure drop across shearable tools may be observed, potentially prematurely shearing these tools. In some instances, the lower lighter fluid or air may be pumped straight across the formation, potentially causing hole instability problems and/or cement placement issues.

Thus, there may be a need for a floatation sub that can open a flow path in a controlled manner, for example to prevent large pressure drops and downhole surges below the fluid separation sub.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
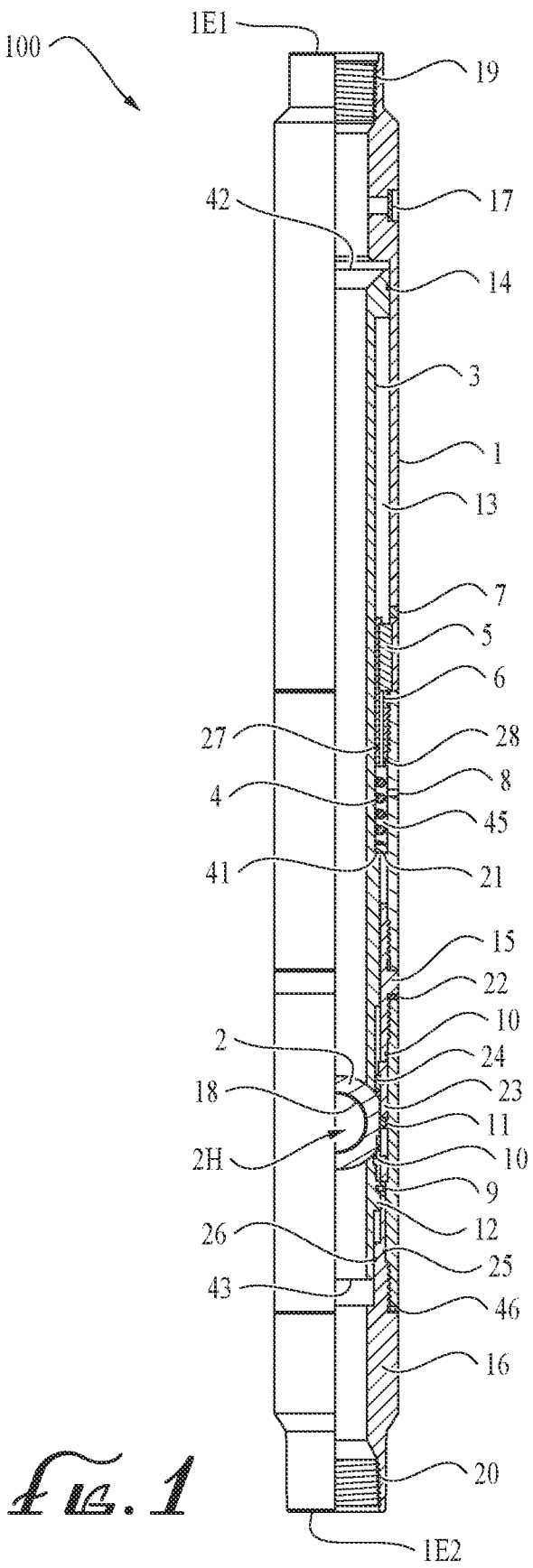
FIG. 1 is a partial cutaway view of an exemplary sub in a closed position, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

According to an embodiment of the disclosure, the sub may be configured to separate fluids and/or air in a downhole string. The sub may be configured to be activated by applying pressure. For example, the application of sufficient pressure in the bore of the sub may initiate the valve opening process, starting a chain of actions in the sub to control the flow rate of the heavier fluid above the sub dropping into a lower section below the sub. In some embodiments, a rotating type ball may be opened at a controlled rate, and/or a number of bypass slots and/or holes may slowly increase the bypass area from above the device to below the device, and thus the fluid drop rate may be controlled. The sub may be configured to avoid instant pressure drop, as the sub may not instantaneously transition from fully closed to fully open. Rather, the opening of the valve of the sub may be drawn out, taking place more slowly over an extended time period. The sub may be configured to prevent large instant pressure surges. Depending on operations, the sub can minimize contact of air with the formation, which can cause open hole and cement placement issues. The sub may also minimize particles left in the string after the sub is activated. This may be advantageous because particles can sometimes interfere with displacement plugs.

The sub may be configured to shift from the fully closed to the fully open position in a controlled manner over a period of time. Thus, fluid above the sub (e.g. in the deployment string) may only be allowed to enter the section below the sub (e.g. the liner) in a controlled manner. At the end of the stoke of a piston of the sub, the sub may be fully open. The sub may minimize the amount of debris in the wellbore after it is activated. Thus, interference with any wipers or plugs which need to be run after the sub is activated may be minimized or prevented.

In some embodiments, when the sub is fully closed, fluid communication from above the sub to below the sub may be prevented. A pressure activation mechanism may start the function of opening the fully closed sub in a controlled manner (e.g., over a predetermined period of time) to a fully open position, controlling the rate of which the fluid above the closed sub enters space below the closed sub. When the sub is fully open, the internal diameter of the bore of the main body may be fully open.

In embodiments, the sub may include a metering device configured to control the time it takes to shift the sub from fully closed to fully open. For example, once pressure activated, the metering device may be in fluid communication with a fluid chamber. Flow of fluid from the fluid chamber through the metering device may result in the piston shifting axially sufficiently to open the valve. Some embodiments of the sub may include a secondary bypass mechanism, which may be used in case the main mechanism of the sub fails to operate.

In some embodiments, the fully closed body in of the sub can be set to activate at various pressures, depending on the wellbore in which it is run. Applied surface pressure may active the metering device. The metering device may cause a fluid communication path from above the sub to below the sub to open slowly. During the metering time frame, an opening of the fluid communication path may increase in size in a controlled manner. At the end of the metering time, the sub may be fully open.

In some embodiments, the sub (which may have a valve) is run in a wellbore in a closed position at a predetermined depth of the well. This may allow the tubulars above the valve to be filled with fluid heavier than the fluid and/or air below the sub. Upon reaching the required setting depth, the sub may be activated (e.g., the valve may be opened) to allow the upper fluid to enter the section below the valve. The valve may open slowly in controlled matter, which may allow the fluid above the valve to enter the section below the valve without creating a sudden pressure surge. Upon the full stroke of the sub (e.g., full stroke of the sub driving the valve to turn), the device may be fully open.

Figure 2:
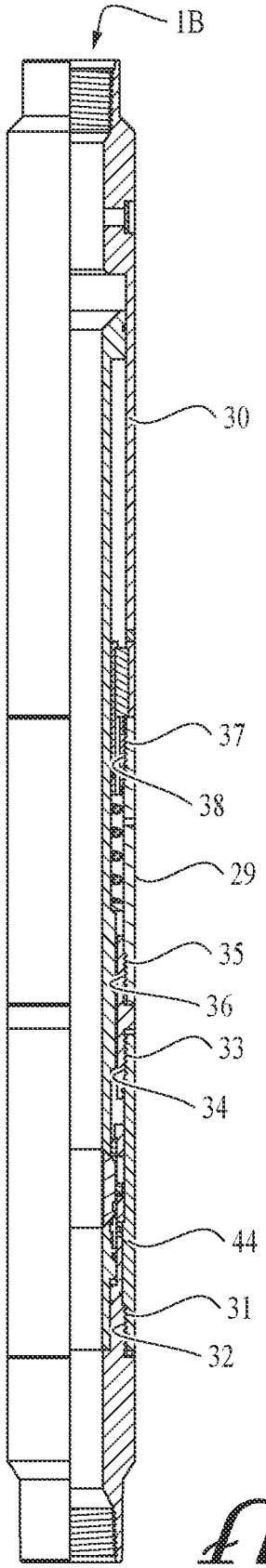
FIG. 2 is a partial cutaway view of the sub of FIG. 1 in an open position.

Referring to FIGS. 1-2, an exemplary apparatus 100 is shown. The apparatus 100 may be generally referred to as a "sub" (or a component of a sub). In general terms, a sub may be a portion of a tubular string and/or downhole assembly, which may be configured to be connected to one or more other portions of the tubular string. For example, one or more subs may be made up into the tubular string. Typically, a sub may have a tubular body, and may be configured to perform one or more functions in a downhole environment. As used herein, the term "sub" may generally refer to a floatation sub. A floatation sub may be any component for aiding in floating a tubular (e.g., a liner). Floating the liner (e.g., providing it with buoyancy) may ease insertion of the liner into a portion of a well (e.g., a horizontal portion). For the purpose of this disclosure, element 100 will generally be referred to as a sub.

The sub 100 according to an embodiment has a body 1 with a longitudinal bore 1B therethrough. In embodiments, a tubular thread 19 or some other mechanism for connecting the sub 100 to a deployment string may be disposed adjacent the upper end. The liner running tool may carry the liner load. Below the sub there may be a number of tools attached, including, but not limited to the plug system. A ball valve 2 may be situated on a first ball support 12 (e.g., a ball support sleeve) in the bore 1B. Between the valve 2 and the first ball support 12 may be a seal 10, which may be configured to prevent fluid from above the valve 2 from entering the area below the ball valve 2 while the ball valve 2 is closed. The first ball support 12 and the ball valve 2 may be axially fixed in the bore (e.g. prevented from moving downwards) during run in by a shearable retaining device 9, such as a shear pin or shear screw. This shearable retaining device 9 can be adjusted to well conditions and setting depths, for example being selected with sufficient retaining strength to prevent premature shearing. Above the ball valve 2 in the sub 100 may be a piston 3 which may seal on the internal diameter of body 1. Downwards compression on the piston 3 against the ball valve 2 may be created by a spring 4 (e.g., a coil spring). In embodiments, the spring 4 may be kept in the compressed state by means of the spring stop 21 situated on an upset on the piston 3. Adjacent the piston 3 and proximate the spring 4 may be a metering device 5 (e.g., comprising an orifice) and a pressure activated mechanism 6 (e.g., a rupture disk). The orifice dimension may stay constant. The viscosity of the metering fluid, downhole temperature, activation pressures for tools above the "sub" may determine the shear value of the pressure activated mechanism 6 (e.g., rupture disk), below the metering device 5. Between the metering device 5 and a seal 14 (e.g., an upper seal) may be a fluid chamber 13 (e.g., an oil chamber), which may also be bounded by the piston 3 and the body 1. The fluid chamber 13 may contain a fluid, for example having viscosity selected based on wellbore conditions (e.g., temperature and setting depth) The fluid chamber 13 may be configured to be filled through a fill port 7. Below the connector 15 may be a camshaft 11, which may cause rotation of the ball valve 2 from the fully closed to the fully open position in a controlled manner (e.g. as the piston 3 transitions axially downward). For example, the camshaft 11 may be configured to interact with the ball valve 2 so as to translate axial movement to rotational movement. A bypass rupture disc may be 17 situated at a top end of body 1, allowing full bypass of the sub 100 without the ball valve 2 fully opening (e.g., in case the pressure activated mechanism 6 fails to rupture).

Upon reaching the required setting depth, pressure may be applied the casing or deployment string. At a predetermined pressure, the pressure activated mechanism 6 may activate (e.g., the rupture disk may rupture), thus allowing the fluid in the fluid chamber 13 to meter in a controlled manner through the metering device 5. The viscous fluid/oil may exit the sub 100 through a bleeder port 8. As the fluid is metering through the metering device 5, the piston 3 may move down in a controlled manner. This downwards movement of the piston 3 may shear the shearing device 9 in the first ball support 12. This downwards movement may allow the first ball support sleeve 12, ball valve 2, and piston 3 to move downwards (e.g. axially downhole). As the ball valve 2 may be connected to the camshaft 11, the ball valve 2 may rotate very slowly from the fully closed to the fully open position, thus preventing the fluid from above the sub 100 from instantaneously dropping into the tubular section below the sub 100. Reducing the pressure drops and downhole surges in this manner may prevent damage to downhole tools. There may be a corrosion resistant insert 18 in the ball valve 2 for preventing washouts.

In some embodiments, an exemplary sub 100 (e.g., a sub) for use in a tubular string includes a body 1 having a longitudinal bore 1B extending therethrough, a valve 2 (such as a ball valve), a pressure activated mechanism 6 (such as rupture disc), a fluid chamber 13, a piston 3, and a metering device 5 (e.g., an orifice metering device). The valve 2 may be configured to be in an (e.g., initial) closed position (e.g. as shown in in FIG. 1) or an open position (e.g. as shown in FIG. 2). When in the closed position, the valve 2 may close the bore 1B (e.g. to prevent fluid flow downhole therethrough). When in the open position, the valve 2 may allow fluid to flow therethrough (e.g. from above the valve 2 to below the valve 2). The valve 2 may be configured to be in a first/closed position or a second/open position (e.g. corresponding to the closed/open positions of the valve 2). The piston 2 may be held in the first/closed position by fluid in the fluid chamber 13. The fluid chamber 13 may be fluidly coupled to the metering device 5. The pressure activated mechanism 6 may be configured to releasably seal the fluid coupling between the fluid chamber 13 and the metering device 5. The pressure activated mechanism 6 may be configured to release its seal upon application of sufficient/pre-set pressure in the bore 1B, thereby allowing fluid in the fluid chamber to exit through the metering device 5. The valve 2 may be configured to translate from its open position to its closed position as fluid exits the fluid chamber 13, thereby driving the valve 2 from its closed position to its open position. Since the fluid in the fluid chamber 13 may exit slowly through the metering device 5, the piston may move axially downward in a slow, controlled manner, which may result in slow, controlled opening of the valve 2.

The body 1 may have a first axial end 1E1 and a second axial end 1E2. In some embodiments, there are threads 19 disposed at the first axial end and/or threads 20 disposed at the second axial end 1E2. In some embodiments, the threads 19,20 are disposed on respective inner surfaces of the body 1. In some embodiments, the bore 1B extends from the first axial end 1E1 to the second axial end 1E2. In some embodiments, the body 1 includes a first casing 30, a second casing 29, a third casing 44, and a fourth casing 16. The first casing may include a rupture disk 17 configured to release fluid in the event that the pressure activated mechanism 6 fails to activate. The first casing 30 may extend axially from the first axial end 1E1 to the second casing 29. The metering device 5 may be disposed between the first casing 30 and the piston 3. A fill port 7 may be formed in the first casing 30. The spring 4 may be disposed between the second casing 29 and the piston 2. An axial end of the first casing 30 may abut an axial end of the second casing 29. Threads 38 of the second casing 29 may engage threads 37 of the pressure activated mechanism 6. In some embodiments, a bleeder port 8 extends radially through the second casing 29 proximate the spring 4. Thus, fluid may flow from the fluid chamber 13, through the metering device 5 (when broken/open) of the pressure activated mechanism 6, through a spring chamber 45, and through the bleeder port 8. A connector 15 may connect the second casing 29 to the third casing 44. For example, threads 36 of the second casing 29 may engage threads 35 of the connector 15, and threads 33 of the connector 15 may engage threads 34 of the third casing 44. Threads 31 of the third casing 44 may engage threads 31 of the fourth casing. In some embodiments, one of more the first casing 30, second casing 29, third casing 44, and fourth casing 16 may be integrally formed instead of being connected by threads. In some embodiments, one or any combination of the first casing 30, second casing 29, third casing 44, and fourth casing 16 may simply be referred to as the body 1.

In some embodiments, a seal 14 is formed in a groove of the piston 3 and configured to make a seal against the first casing 30. In some embodiments, a seal 27 is formed in a groove in the pressure activated mechanism 6 (e.g., formed in an interior surface of the pressure activated mechanism 6) and configured to seal against the piston 3. In some embodiments, a seal 28 is formed in a groove of the pressure activated mechanism 6 (e.g., formed in an exterior surface of the pressure activated mechanism 6) and configured to seal against the second casing 29 (and/or body 1). In some embodiments, the connector 15 may abut the piston 3 and may be configured to slide against the piston 3. In some embodiments, a seal 10 may be disposed in a groove of the connector 15 and may be configured to make a seal against the third casing 44. In some embodiments, the apparatus 100 may include a guide ring 24 configured to slide along the control frame 23 when the ball valve 2 transitions from and open state to a closed state. In some embodiments, the guide ring 24 may be fixed to the piston 3 and disposed radially inward with respect to the the control frame 23.

In some embodiments, a set screw 22 fastens the third casing 44 to the connector 15. In some embodiments, a set screw 46 may fasten the third casing 44 to the fourth casing 16. In some embodiments, a shearable retaining device 9 (e.g., a shear pin) may extend from the third casing 44 to the first ball support 12. In some embodiments, the shearable retaining device 9 may be disposed between the control frame 23 and the fourth casing 16. In some embodiments, when the valve 2 is in the open state, the first axial end 1E1 and the second axial end 1E2 of the body 1 may be in fluid communication by the bore 1B and a hole 2H in the ball valve 2. That is, the hole 2H may be aligned with the bore 1B. In some embodiments, when the valve 2 is in the closed state, the first axial end 1E1 and the second axial end 1E2 of the body 1 are not in fluid communication. That is, the hole 2H may not be aligned with the bore 1B, preventing flow therethrough. In some embodiments, the piston 3 may be hollow (e.g., the bore 1B extends through the piston 3). In some embodiments, the valve 2 is at least partially disposed within the piston 3.

Figure 3:
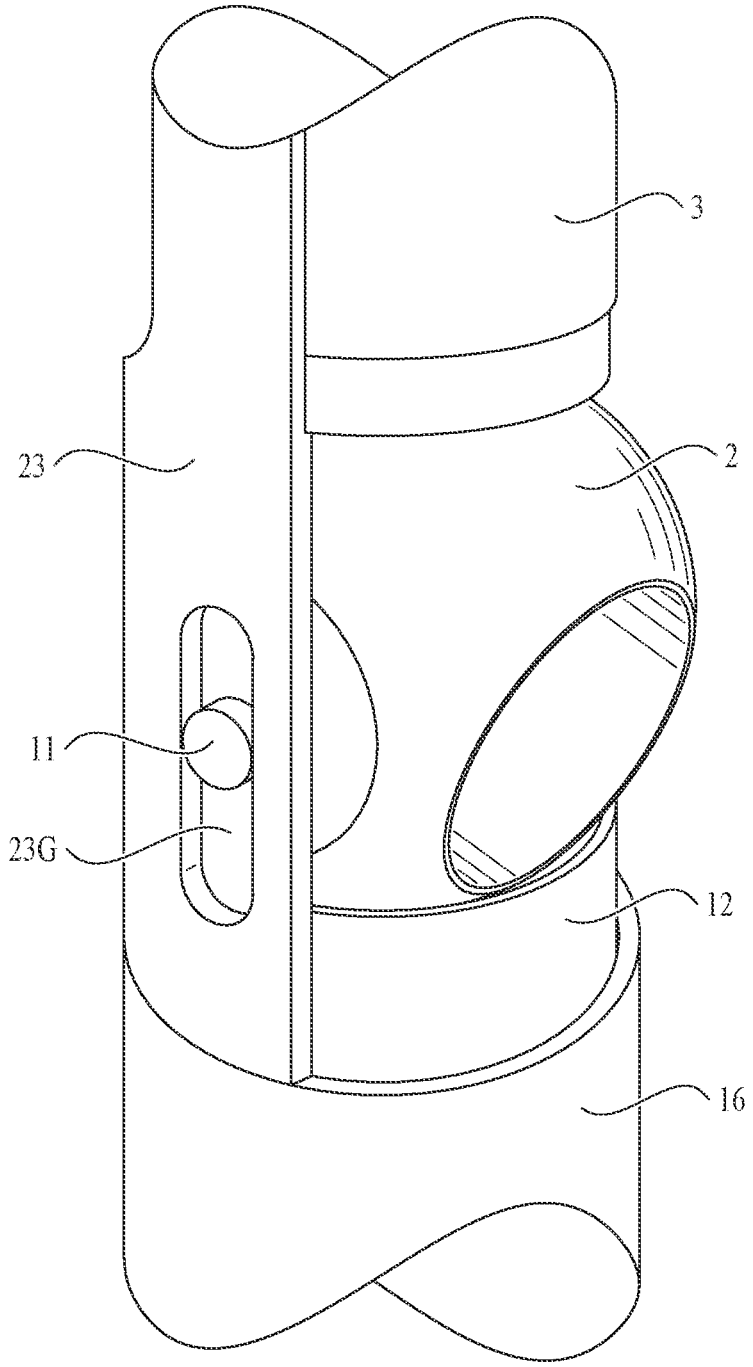
FIG. 3 is a perspective view of an exemplary valve and related components of the sub of FIG. 1.
Figure 4:
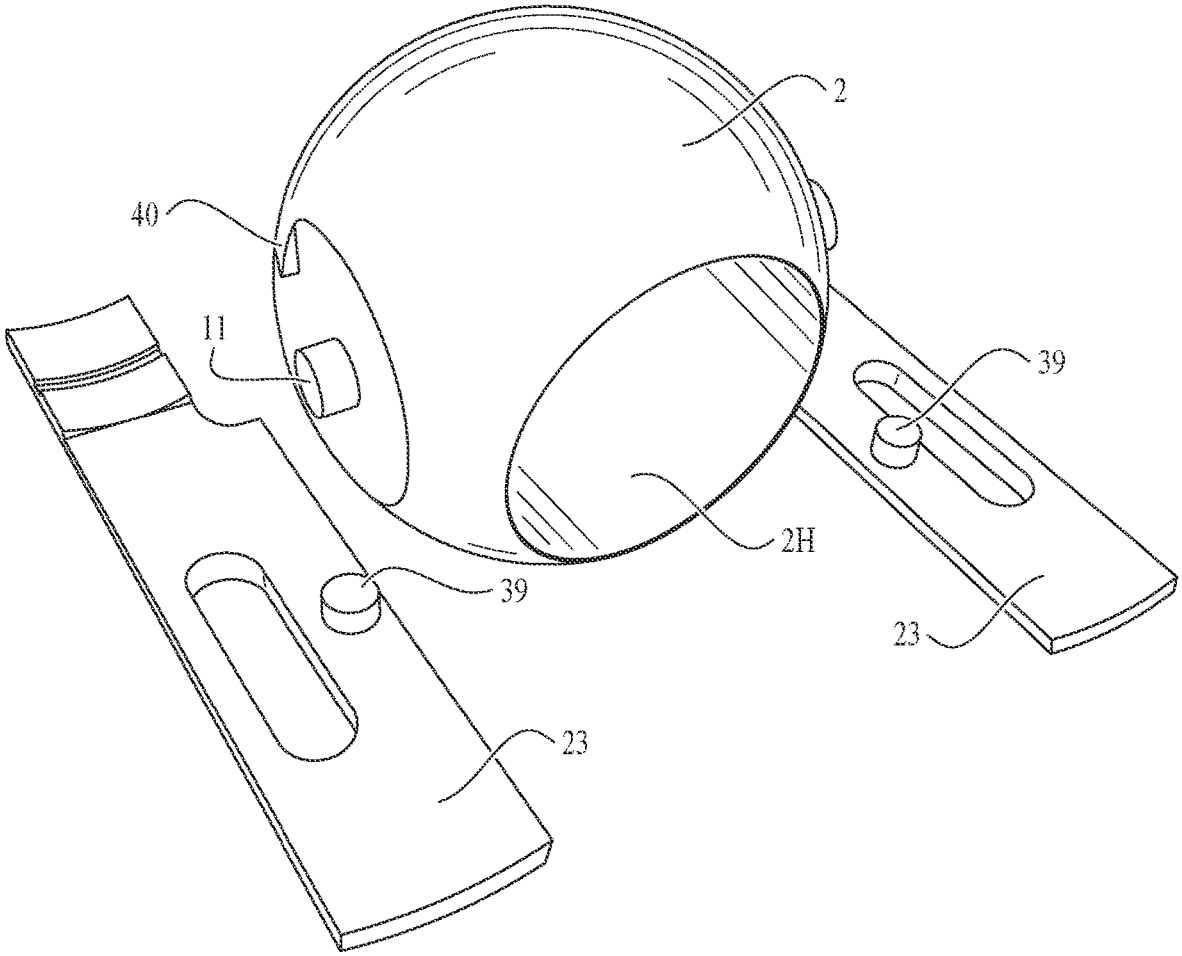
FIG. 4 is an exploded view of the valve and control frames of the sub of FIG. 1.

Referring to FIGS. 3-4, a camshaft 11 may extend from opposing axis of the ball valve 2. Each camshaft 11 may extend through (or terminate at least partially inside) a groove 23G formed in the control frame 23. Each control frame 23 may be disposed on opposite sides of the ball valve 2. The control frames 23 may be arranged parallel to one another. The control frames 23 may abut a groove in the body 1 (e.g., the third casing 44) and/or the connector 15. Thus, the control frames 23 may be fixed with respect to the body 1. The camshafts 11 may be fixed to the ball valve 2 and may be configured to slide axially in the grooves 23G.

The control frames 23 may each comprise control pins 39 extending radially inward. The control pins 39 may be configured to exert a force on lips 40 formed on opposite ends of the ball valve 2 such that when the ball valve 2 translates axially (as the camshafts 11 slide in the grooves 23G), the ball valve 2 also rotates such that the holes 2H in the ball valve 2 rotate to align with the bore 1B to open a fluid pathway along the bore 1B. The control pins 39 and/or the lips 40 may be disposed off-center from an axis of rotation of the ball valve 2. The camshaft 11 may be disposed on or near a center of rotation of the ball valve 2.

Referring to FIGS. 1-4, the apparatus 1 may function as follows. The sub 100 may be disposed in a well. A buildup in fluid pressure in the bore 1B may act on the ball valve 2, piston 3, and o-ring 14. This ID (borehole) pressure may be trying, as it were, to move piston 3 downward axially, thus trying to force the fluid in chamber 13 through the pressure activated mechanism 6 (e.g. a rupture disc). This causes an increase in pressure of the fluid in the fluid chamber 13. When pressure in the fluid chamber 13 reaches the level necessary to activate/open the pressure activated mechanism 6 (e.g. reaches the rupture value of rupture disc), the fluid from chamber 13 will bleed through the rupture disc, flowing through the metering device 5 to exit through bleeder port 8. In embodiments, fluid from the fluid chamber 13 lows through the metering device, through the spring chamber 45, and out through the bleeder port 8. Because flow of the fluid from the fluid chamber 13 is restricted to passing through the metering device 5, downward motion of the piston 3 is damped (e.g., the piston 3 moves more slowly than it would without the damping). As the piston 3 translates axially, it may exert a downward force on the ball valve 2, first ball support 12, and shearable retaining element 9 (for example causing downward axial movement). In embodiments, the downward force on the ball valve 2 may cause the camshafts 11 to translate within the grooves 23G of the control frame 23. Simultaneously, the control pins may 39 exert force on the lip 40 to rotate the ball valve 2 so that the hole 2H aligns with the bore 1B (e.g., the valve 2 opens). In embodiments, the process of the valve 2 opening (e.g., the time for the valve to transition from a closed state to an open state) may take several minutes, depending on well conditions and fluid used in fluid chamber 13 and rupture disc settings. Because a denser fluid may be disposed in the bore 1B above the closed valve 2 and a less dense fluid may be disposed in the bore 1B below the valve 2, shock may be mitigated or eliminated (e.g., due to prevention of sudden influx of the denser fluid by virtue of the valve 2 opening slowly). Shock from conventional floatation subs may dislodge a wiper plug from the deployment string (e.g., breaks pins and/or collet release mechanism between the deployment string and the wiper plug). Moreover, severe shocks may break down the formation. Conventional rupture disks may cause shocks because fluid of approximately 8,000 or 9,000 psi may be released suddenly. However, in some embodiments of the present disclosure, because of the damping action, the valve 2 may open slowly so that the heavier fluid above the valve 2 (e.g. drilling fluid) does not cause a shock. For example, the valve 2 may take 5-15 minutes to rotate from the closed position to the open position, opening gradually and/or incrementally over such timeframe.

Figure 5:
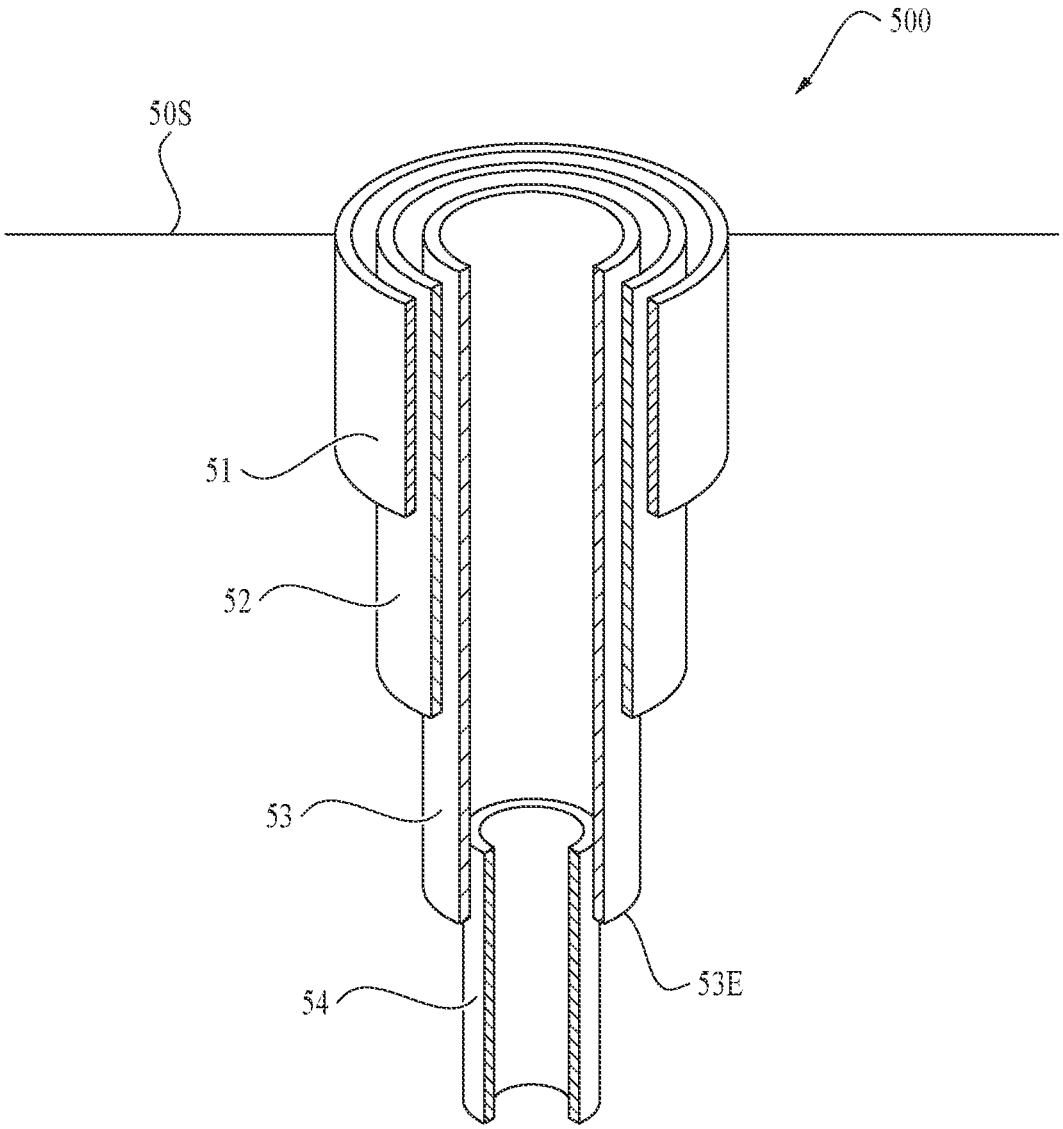
FIG. 5 is a schematic diagram of an exemplary tubular assembly, according to an embodiment of the present disclosure.

Liners may be configured to hang from the bottom of casing or another liner, for example with the liner not extending all the way upward to the surface. Referring to FIG. 5, an exemplary tubular assembly 500 is shown according to an embodiment. A conductor casing 51 may be the largest-diameter tubular in the tubular assembly 500 and may extend from the surface 50S. A surface casing 52 may have a smaller diameter than the conductor casing 51 and may extend from the surface 50S. An intermediate casing 53 may have a smaller diameter than the surface casing 52 and may extend from the surface 50S. The liner 54 may have a smaller diameter than the intermediate casing 53 and extend from a downhole end 53E of the intermediate casing 53. That is, the liner 54 may not extend all the way up to the surface 50S. This may be advantageous because it may save on costs (e.g., the liner 54 does not have to be as long).

Figures 6A, 6B, 6C, 6D, 6E, 6F, 6G:
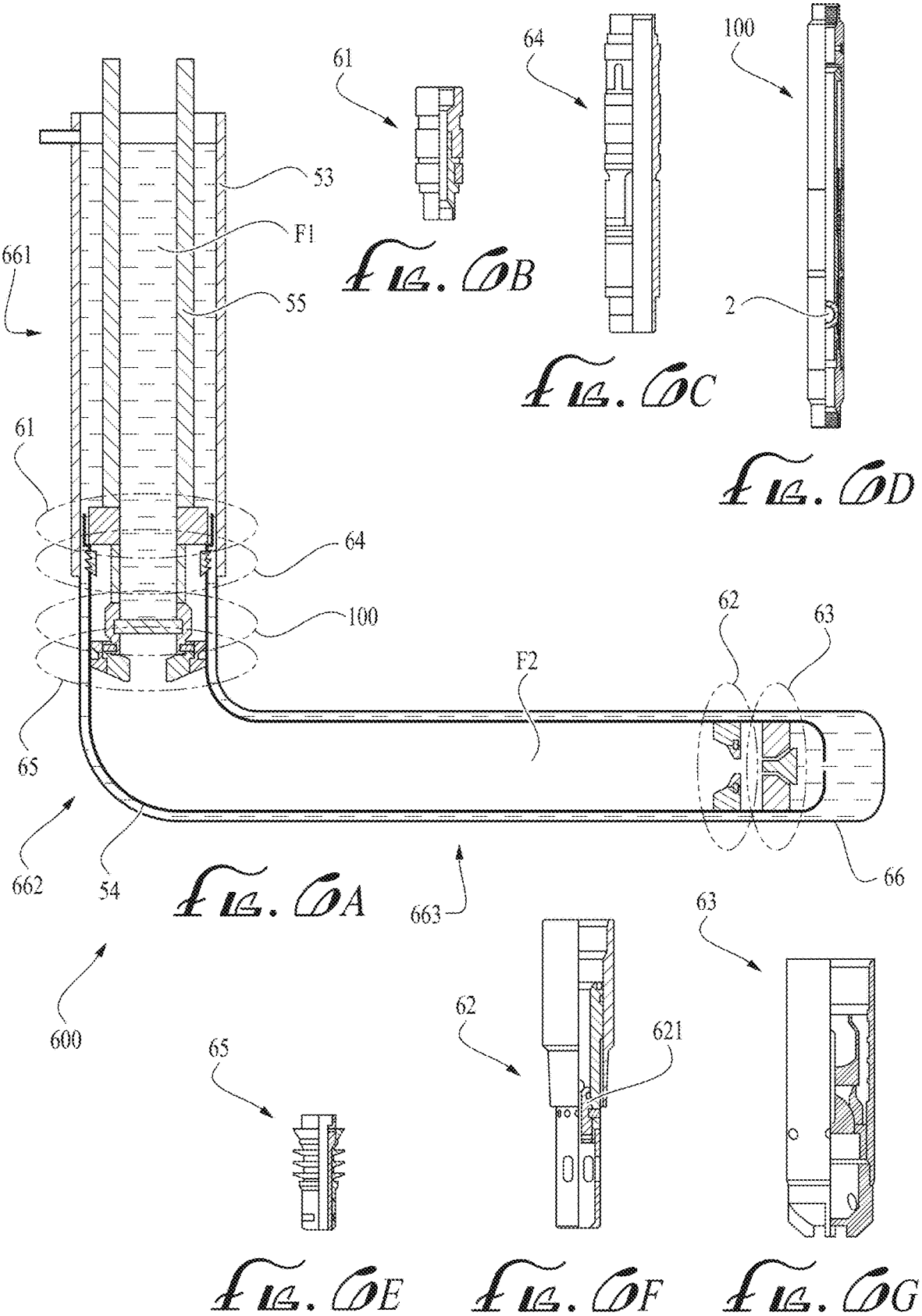
FIG. 6A is a schematic diagram of an exemplary system for installing a liner in a well, with the valve of the sub closed, according to an embodiment of the present disclosure.
FIG. 6B is a quarter section view of a liner disconnect, according to an embodiment.
FIG. 6C is a quarter section view of a liner hanger, according to an embodiment.
FIG. 6D is a quarter section view of a sub, according to an embodiment.
FIG. 6E is a quarter section view of a wiper plug, according to an embodiment.
FIG. 6F is a quarter section view of a landing collar, according to an embodiment.
FIG. 6G is a quarter section view of a floating valve, according to an embodiment.

Referring to FIG. 6, an exemplary system for installing liner 54 in a well, according to an embodiment, may include the sub 100, a deployment string 55, a liner disconnect 61, a liner hanger 64, a landing collar 62, and a floating valve 63. In some embodiments, the wellbore 66 may include a vertical portion 661, a curved portion 662, and a horizontal portion 663. In some embodiments, the deployment string 55 may be at least partially disposed inside the vertical portion 661. In some embodiments, the deployment string 55, the liner disconnect 61, and the sub 100 may also be disposed in the vertical portion 661. In some embodiments, the landing collar 62 and the floating valve 63 may be disposed in the horizontal portion 663 (e.g., at or near the toe of the wellbore 66). The liner disconnect 61 may be attached to a deployment string 55, the sub 100 may be attached to the liner disconnect 61, and the wiper plug 65 may be attached to the sub 100. The sub 100 may be a floatation sub (e.g., the sub 100 may facilitate floating of the liner 54 inside the wellbore 66). The liner disconnect 61, the sub 100, the wiper plug 65, the landing collar 62, and/or the floating valve 63 may be disposed inside the liner 54. The liner 54 may be partially disposed within the casing 53. FIG. 6 shows the configuration in which the liner 54 is not yet installed, and thus the liner hanger 64 is not yet engaged to fix the liner 54 to the casing 53. In the configuration of FIG. 6, sub 100 may have the ball valve 2 in the closed position, and thus the denser first fluid F1 (e.g., drilling fluid) may be disposed above the sub 100 and the less dense second fluid F2 (e.g., air) may be disposed below the sub 100. The denser first fluid F1 may be isolated from the less dense second fluid F2 because the valve 2 is closed. The liner 54 may be run to the required setting depth (e.g., near the bottom of the previous casing string) with the presence of the less dense second fluid F2 helping it float into place. In some embodiments, due to the sub 100 being closed, no circulation may be possible until the sub 100 is opened.

Figure 7:
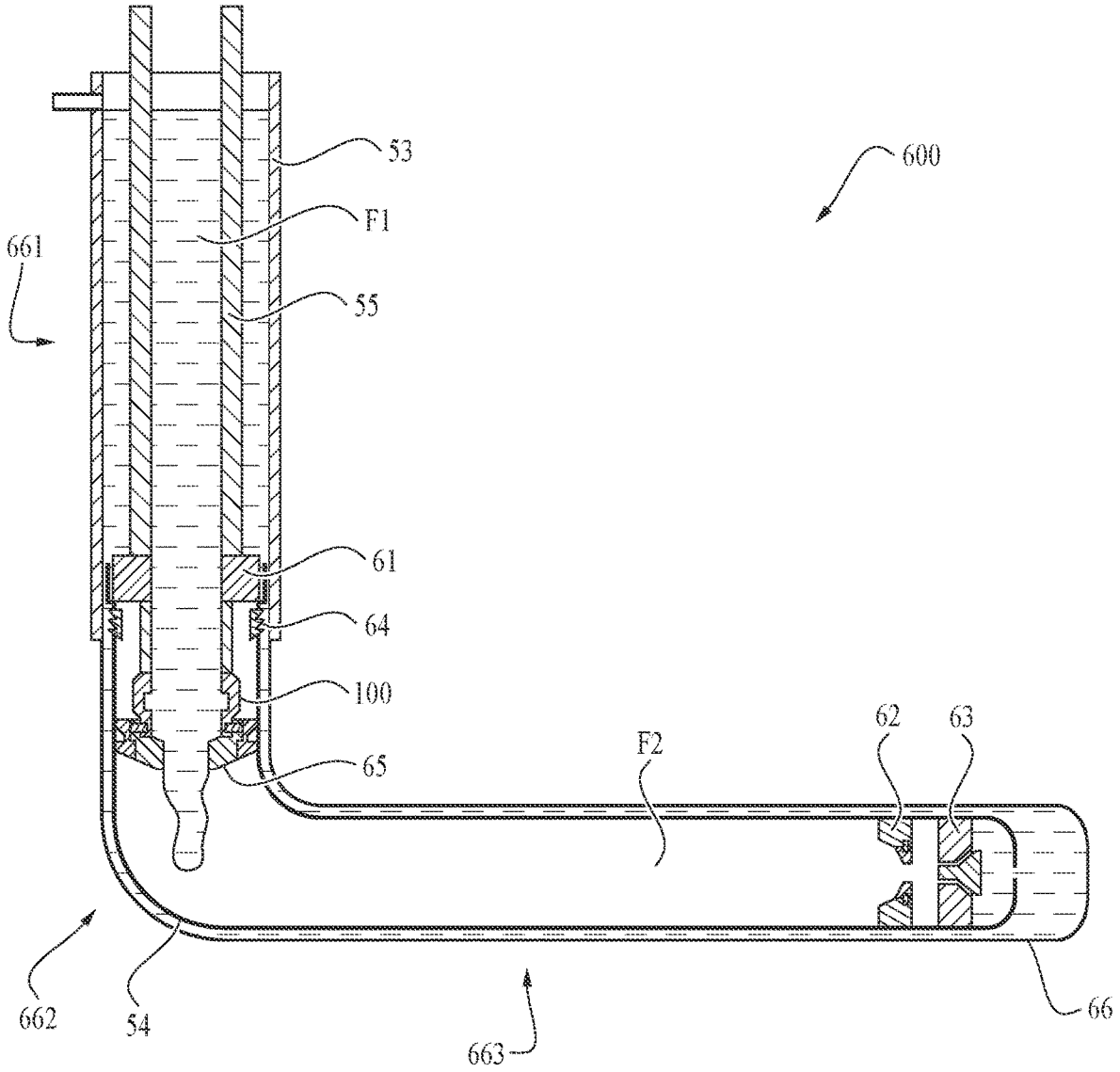
FIG. 7 is a schematic diagram of the system of FIG. 6 with the valve slowly opening.

Referring to FIG. 7, at the required setting depth, the sub 100 may be activated by pressure from the surface. That is, the pressure in the first fluid F1 initiates the process of slowly opening the ball valve 2 (e.g. as discussed herein, for example with respect to FIGS. 1-2). Slowly opening the ball valve 2 may control the velocity (or flow rate) of first fluid F1 above the valve 2 to entering the liner 54, which may be filled with the less dense second fluid F2 (e.g., less dense than the first fluid F1). That is, in the sub 100, the valve 2 may open in a manner that allows flow of the denser first fluid F1 therethrough while preventing large pressure drops and/or downhole surges. Thus, shock is reduced or eliminated, which may prevent the wiper plug 65 from being prematurely/unintentionally released. This may also prevent contaminated cement from entering the open hole section.

Figure 8:
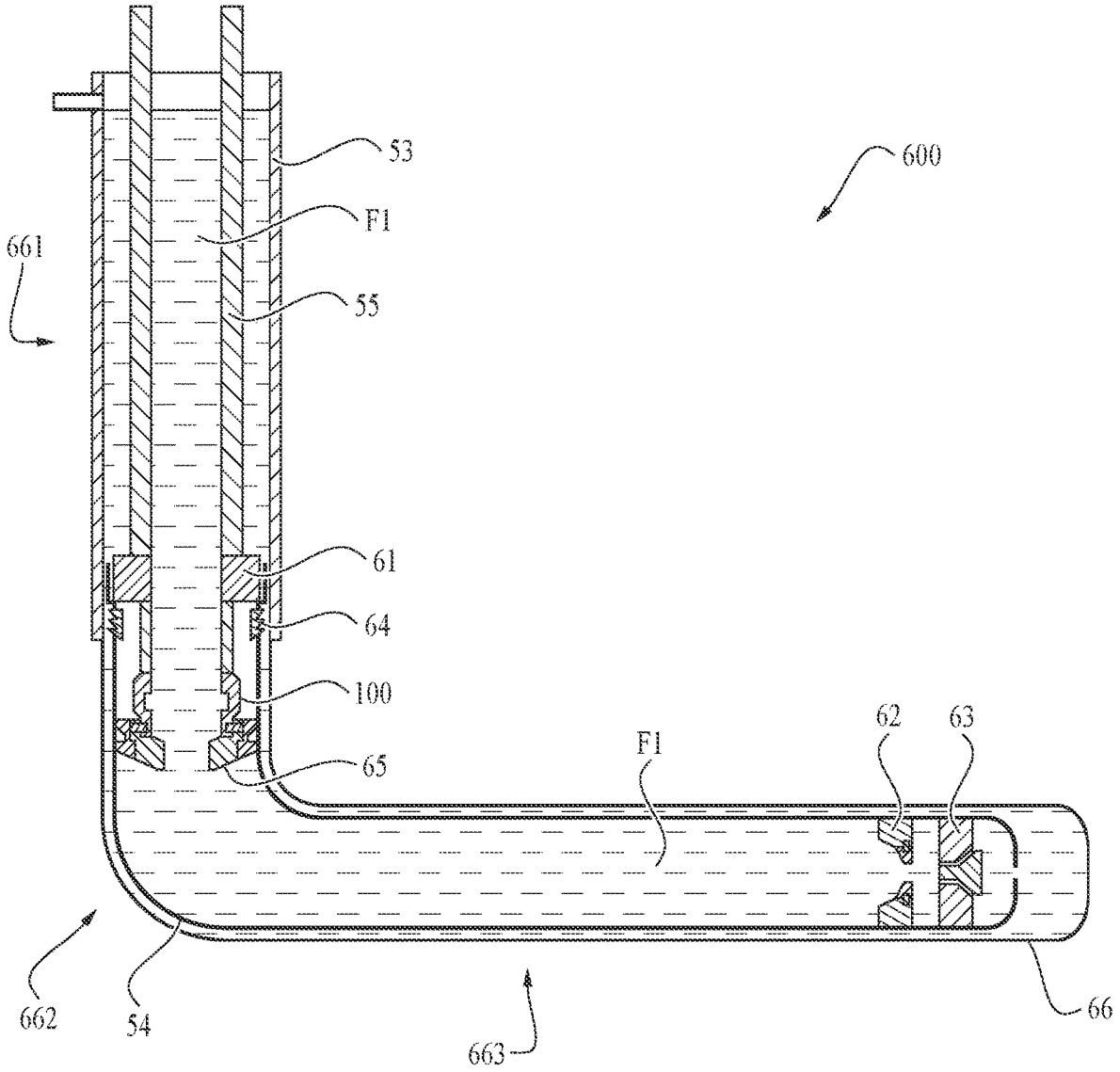
FIG. 8 is a schematic diagram of the system of FIG. 6 with the valve open.

Referring to FIG. 8, in this exemplary embodiment, the first fluid F1 has completely filled the liner 54 and the second fluid F2 has been displaced. The liner may be still attached to the deployment string 55 and may not be able to move downhole. Depending on how much of the liner is in the vertical section vs the horizontal section may determine whether the liner will move.

Figure 9:
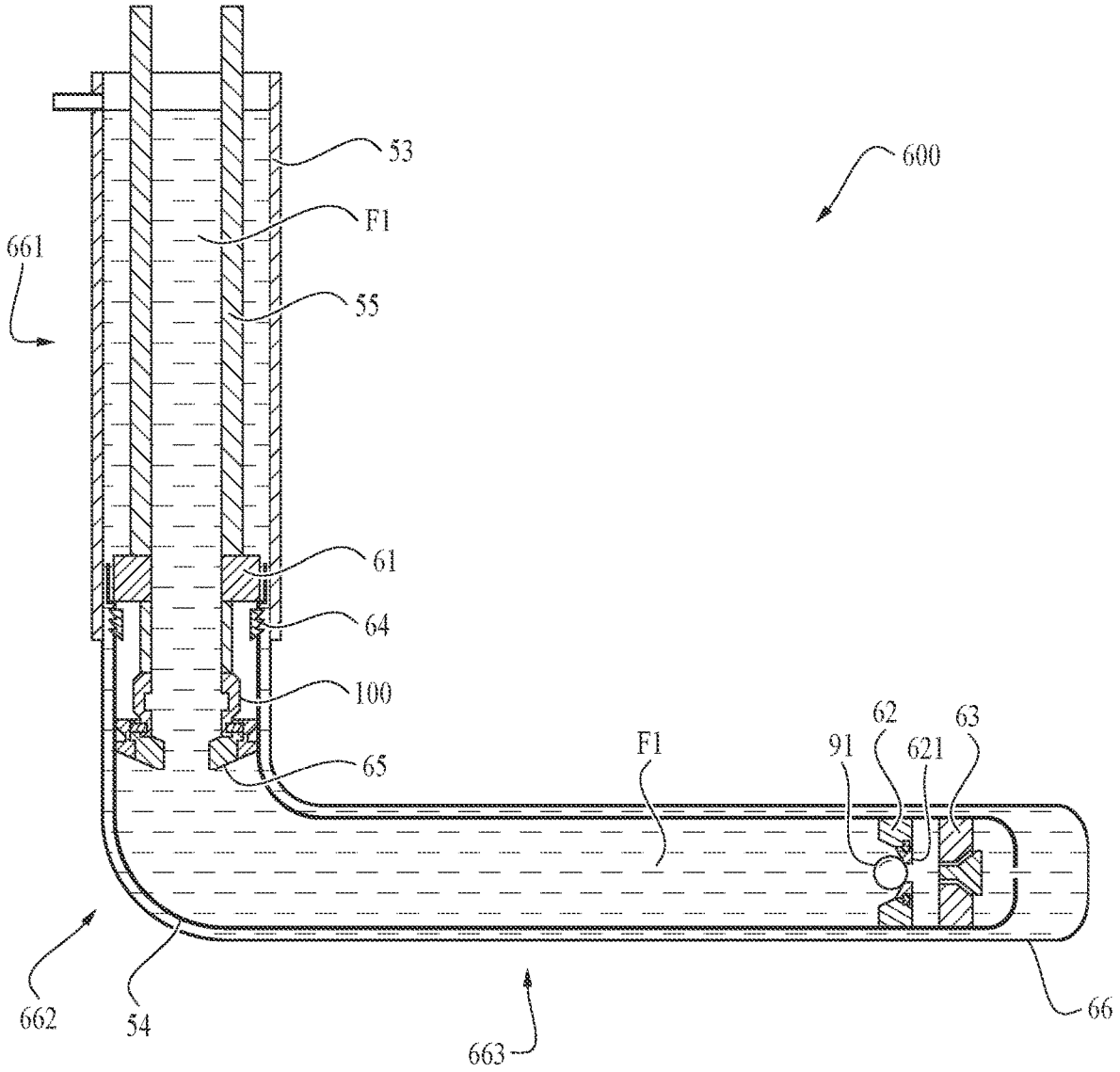
FIG. 9 is a schematic diagram of the system of FIG. 6 with a setting ball dropped on a landing collar.

Referring to FIG. 9, a ball 91 may be dropped from the surface through the deployment string 55 and liner 54 and land on the landing collar 62, thus preventing the first fluid F1 from being pumped into the annulus. In some embodiments, the landing collar 62 may have ball seat 621 for the ball to fall into.

Figure 10:
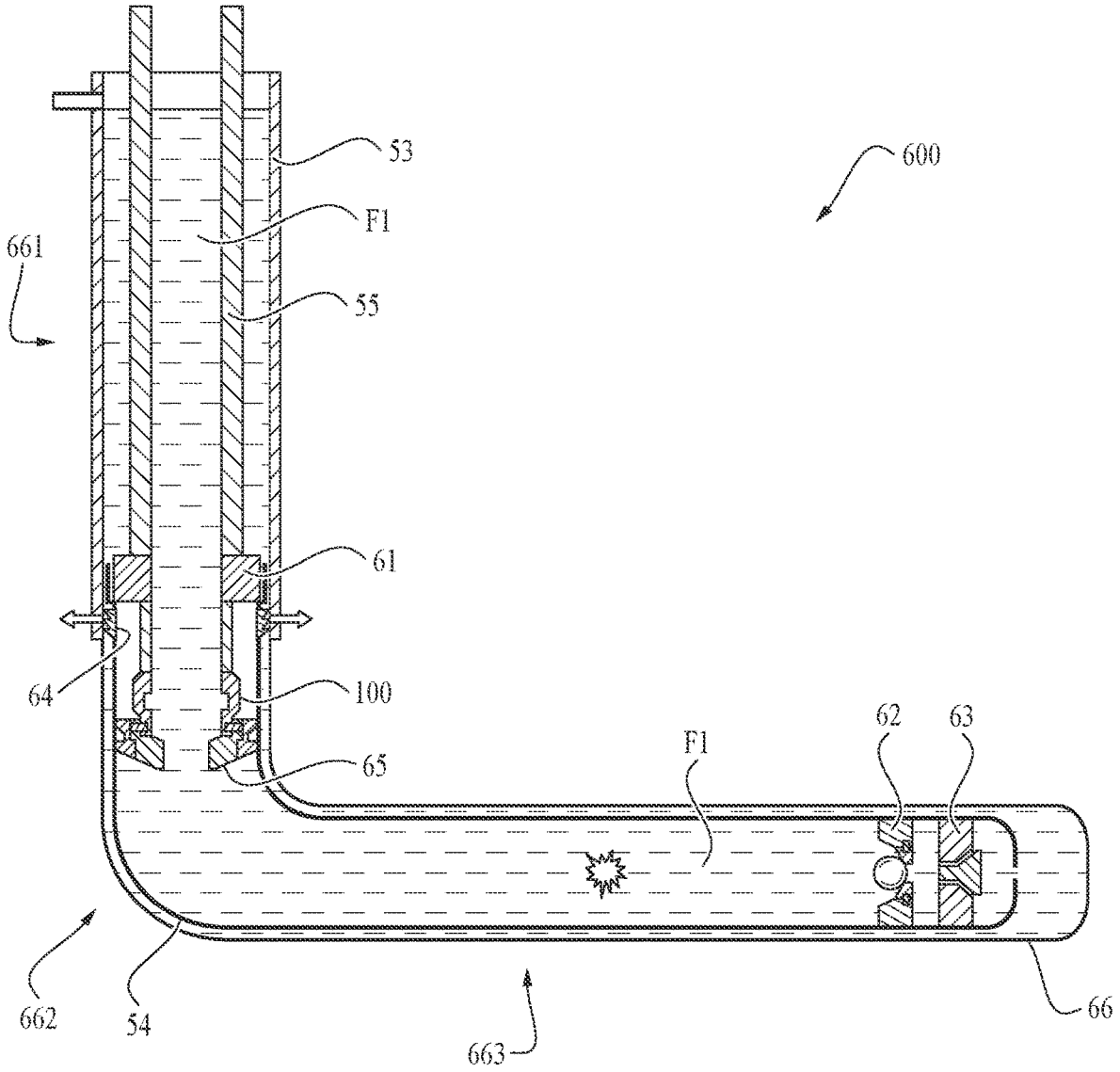
FIG. 10 is a schematic diagram of the system of FIG. 6 with pressure applied to move out anchoring slips to secure the liner.

Referring to FIG. 10, the first fluid F1 may be pressured up by pumping additional fluid into the deployment string 55 and liner 54. The ball 91 may prevent the fluid from escaping into the wellbore 66. Relatively higher pressure inside of the liner hanger 64 as compared to the outside of the liner hanger 64 (e.g., differential pressure) may push anchoring slips of the liner hanger 64 outward against the inner diameter of the casing 53. Thus, the liner 54 may be secured to the casing 53 (e.g., the liner 54 can no longer be moved down hole (it is set-anchored)). With the line hanger 64 set, the pressure of the first fluid F1 may be further increased to hydraulically release the liner disconnect 61, thus separating the deployment string 55 from the liner 54. Even after the release, the deployment string 55 may stay in position to assist with further steps of the process.

Figure 11:
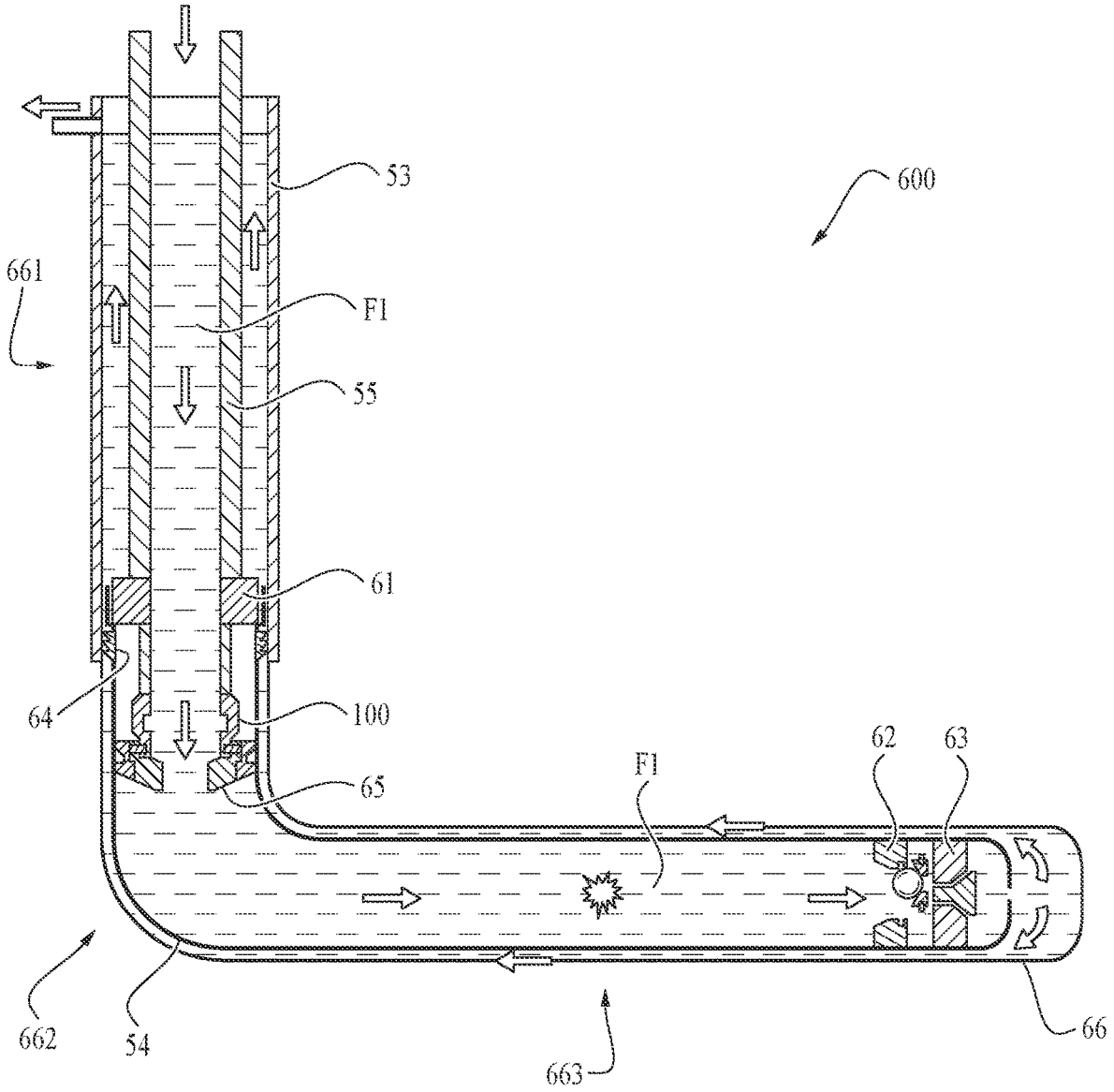
FIG. 11 is a schematic diagram of the system of FIG. 6 with additional pressure applied to shear the ball seat to open circulation.

Referring to FIG. 11, internal pressure may be further increased to shear the ball seat 621 (which has the ball 91 on it) off the land landing collar 62. Thus, circulation may be restored in the string (e.g., the casing 53 and the liner 54).

Figure 12:
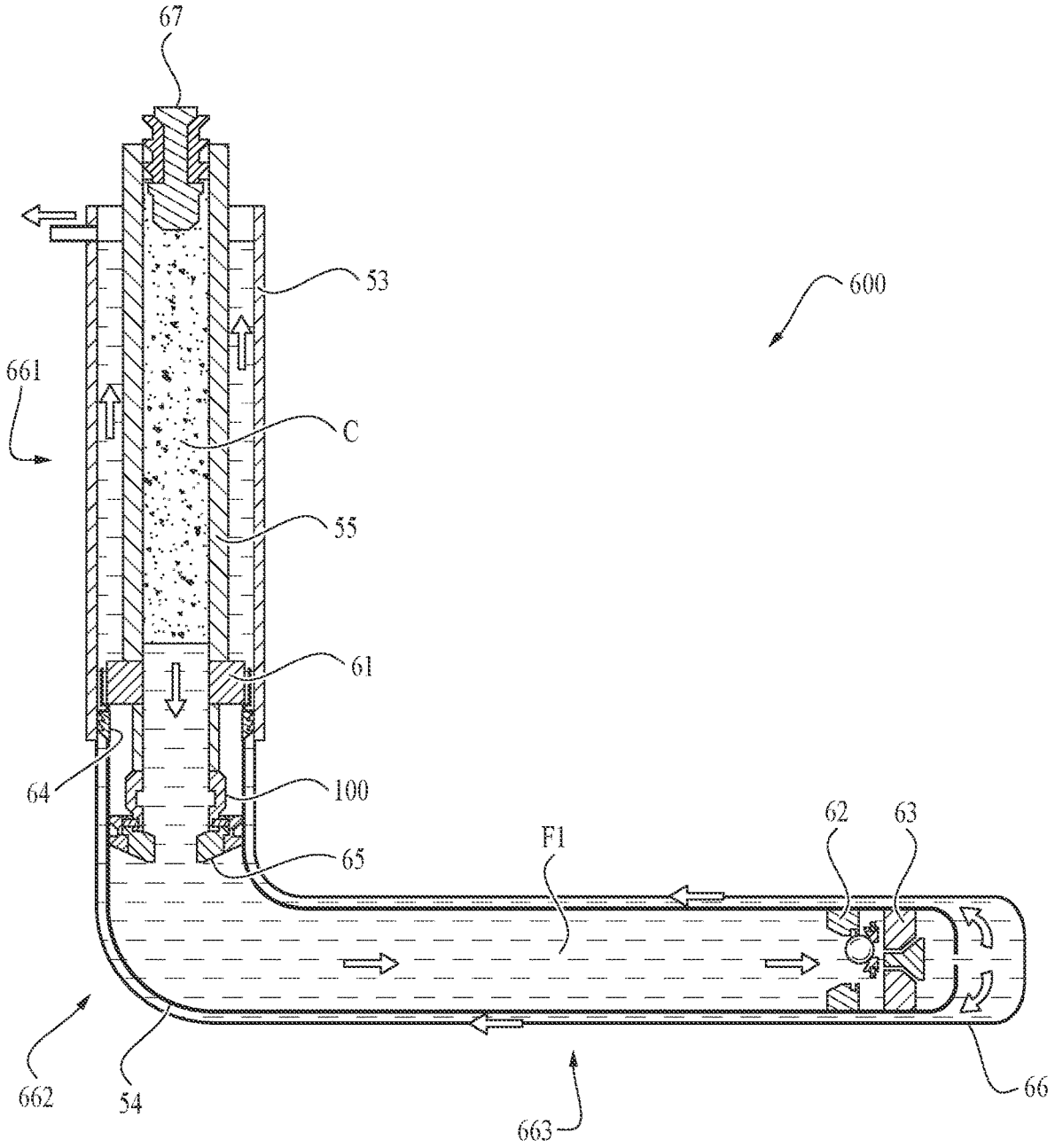
FIG. 12 is a schematic diagram of the system of FIG. 6 with cement being pumped down the deployment string followed by a wiper dart.

Referring to FIG. 12, cement C may be pumped into the deployment string 51. A wiper dart 67 may be placed in the deployment string 51.

Figure 13:
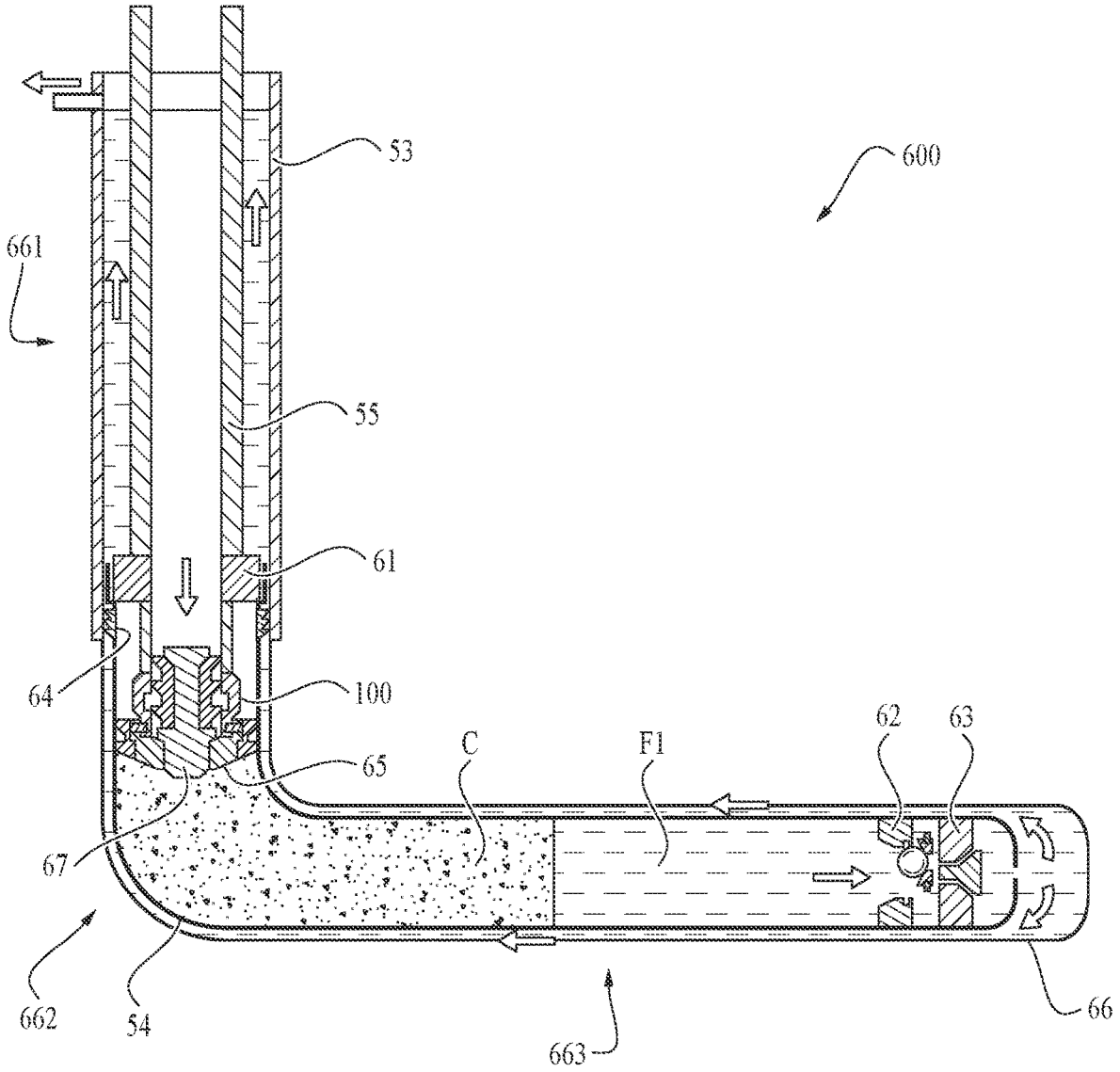
FIG. 13 is a schematic diagram of the system of FIG. 6 with the wiper dart latched to the wiper plug.

Referring to FIG. 13, the wiper dart 67 may be pumped down to the wiper plug 65. In some embodiments, the wiper dart 67 may be latched onto the wiper plug 65. At this step, the cement C may be disposed in the liner 54.

Figure 14:
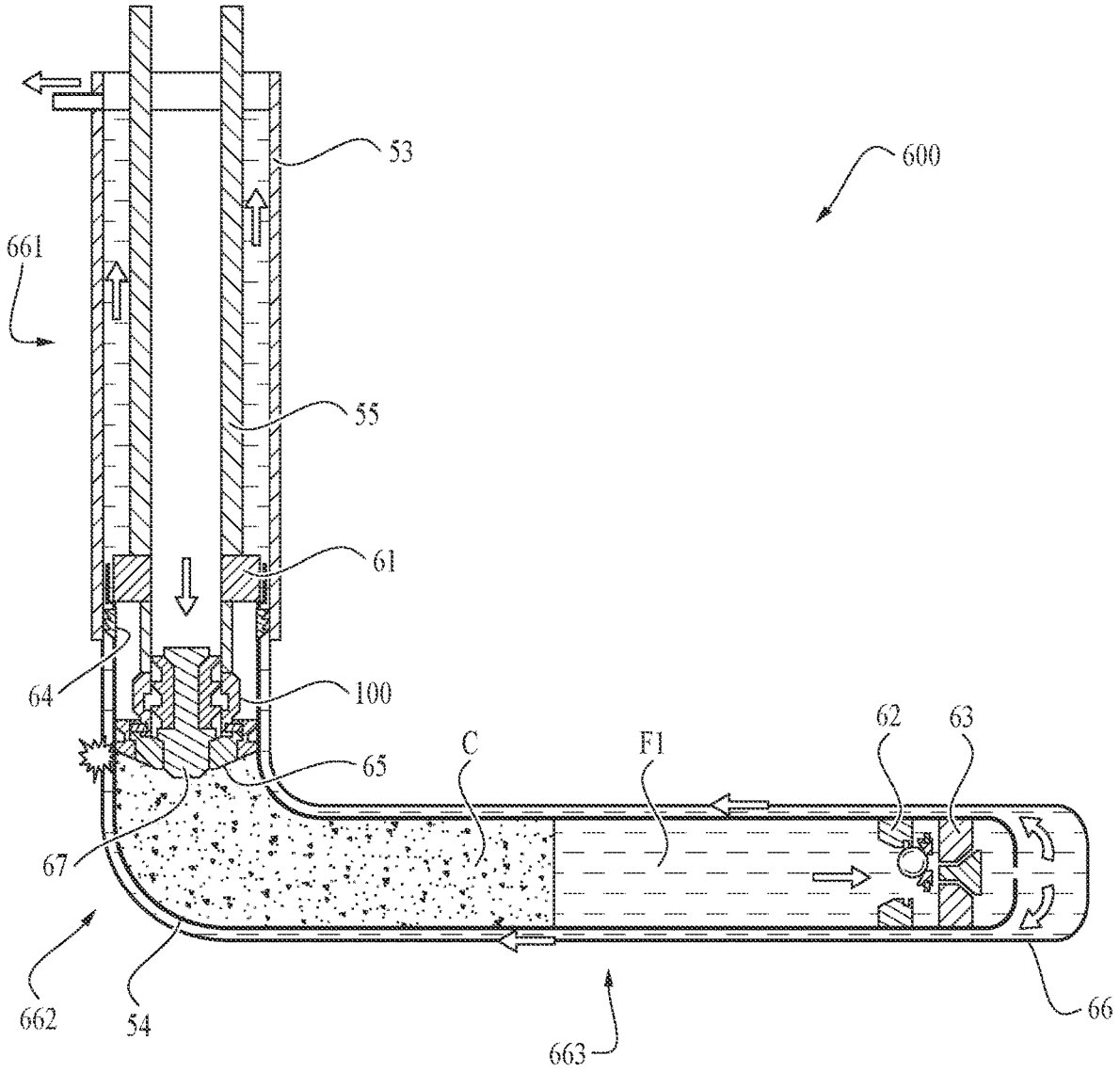
FIG. 14 is a schematic diagram of the system of FIG. 6 with a pressure increase to shear the wiper plug.

Referring to FIG. 14, pressure may be increased. At a predetermined pressure (e.g., when the pressure reaches a threshold), the wiper plug 65 may be sheared off the sub 100.

Figure 15:
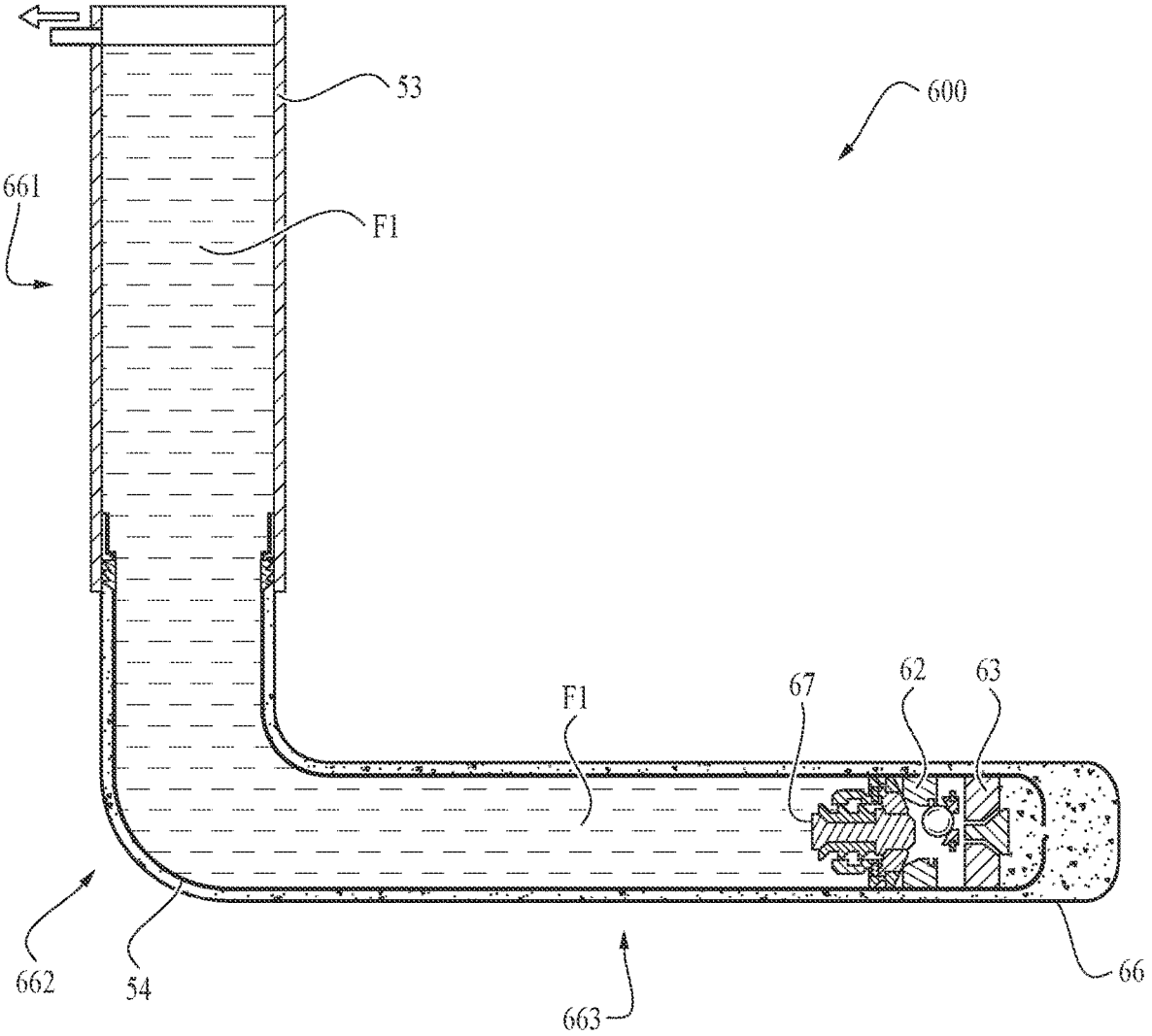
FIG. 15 is a schematic diagram of the system of FIG. 6 with the wiper plug placed on the landing collar.
Figure 16:
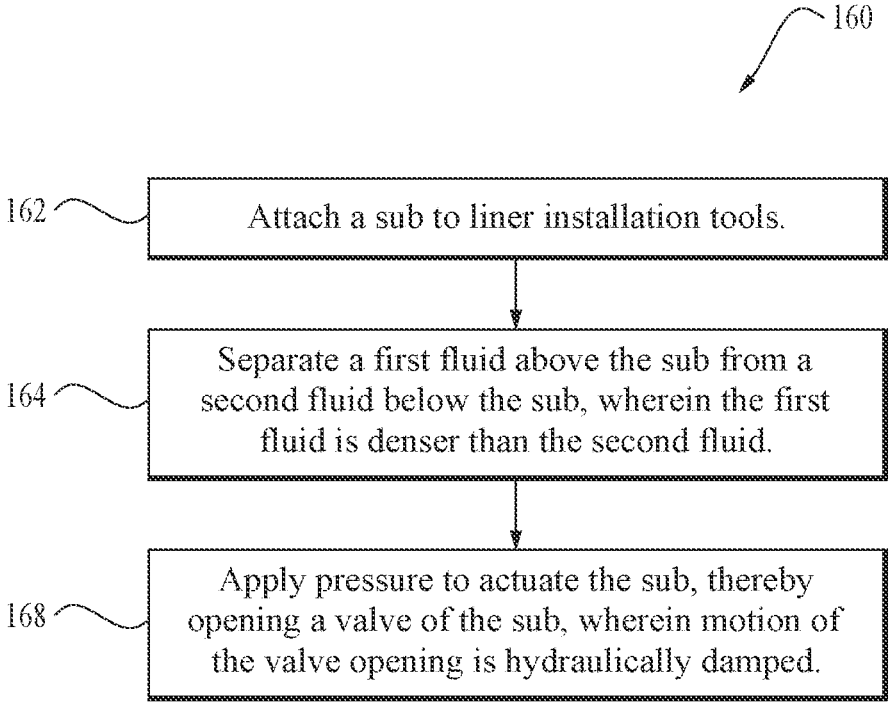
FIG. 16 is a flow diagram of an exemplary method for introducing fluid into a liner, according to an embodiment.

Referring to FIG. 15, the joined wiper dart 67 and wiper plug 65 may be pumped down the liner 54 to the landing collar 62, and a pressure increase in the first fluid F1 may be observed. All the cement C may be placed on the outside of the liner 54, from the liner shoe to the top of the liner hanger 64. Floats at the bottom of the liner may prevent the cement C from U-tubing (e.g., because cement is denser than drilling fluid). As an example, the cement C may be pumped down the liner 54, through a check valve, and outside the liner. When the operator sees returns at the surface, it may be inferred how much cement C has been added. The deployment string 55, the liner disconnect 61, and the floatation sub 100 may be removed/retracted/pulled out of the hole. The well may now be ready for the operator to drill deeper or complete the well. It may be advantageous that the sub 100 is retrieved from the wellbore 66 after the operation is finished. Removing the sub 100 may avoid the possibility of a leak path which can form in conventional subs. The sub 100 may also be reused in the same well or in a different well.

Figure 18:
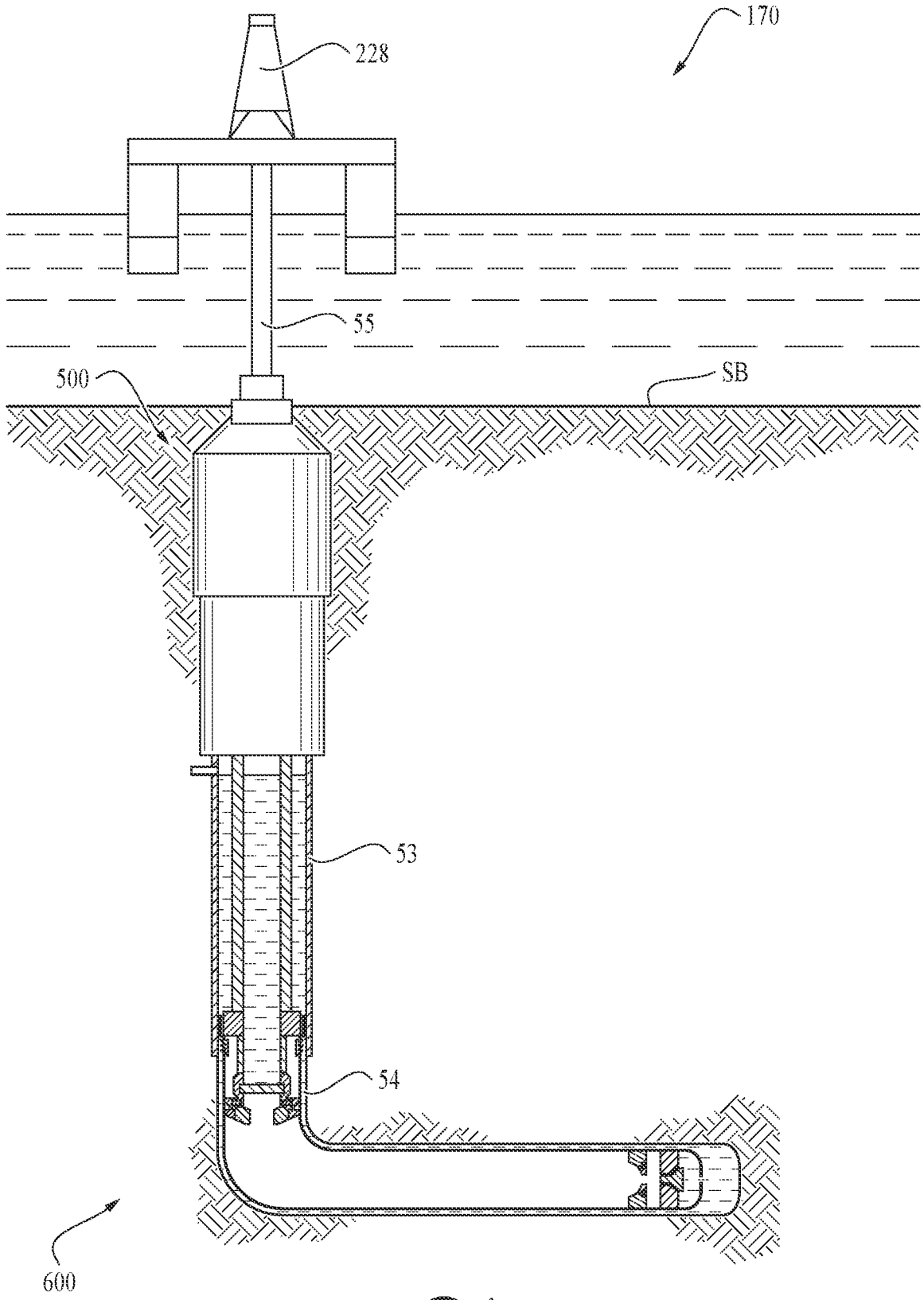
FIG. 18 is a schematic diagram of an exemplary well operation, according to an embodiment.

In some embodiments, the sub 100 may be used in deep water applications. Referring to the exemplary embodiment of FIG. 18, the well operation 170 may include a tubular assembly 500 on the sea bed SB. For example, casing strings (e.g., the conductor casing 51, surface casing 52, intermediate casing 53, and/or liner 54) may installed by the deployment string 55, which may extend from a rig 228 to and/or through the tubular assembly 500. The system 600 may be disposed in the intermediate casing 53 of the tubular assembly 500 and/or in the liner 54 of the tubular assembly 500. The system 600 may be configured to float the liner 54 (e.g., the liner 54 may be filled with first fluid F1 (e.g., air)), introduce a second fluid F2 (e.g., drilling fluid) into the first fluid F1 inside the liner 54 in a controlled manner, and fix the liner 54 to the intermediate casing 53 as explained in the various embodiments disclosed herein. The sub 100 may hydraulically damp opening of the valve 2 of the sub 100 for the controlled introduction of the second fluid F2 from inside the intermediate casing 53 into the second fluid F2 inside the liner 54. While the example of FIG. 18 refers to a deep water application, usage of the system is not so limited. For example, the system may be used in land based systems.

An exemplary method 160 for deploying/installing a liner 54 downhole in a well may include in step 162 attaching a sub to liner installation tools (e.g. with the horizontal portion of liner below the sub); running the liner and sub downhole in the well (e.g. using a deployment string); in step 164 separating first fluid (e.g. a denser fluid) above the sub from second fluid (e.g., a less dense fluid) below the sub; and at step 166 applying pressure (e.g. in the bore when the valve of the sub is closed) to actuate the sub, thereby opening a valve of the sub, wherein motion of the valve opening is hydraulically damped.

In some embodiments, the method may further include activating/rupturing the pressure activated mechanism/rupturable element, thereby releasing fluid from the fluid chamber through the metering device. Releasing fluid through the metering device may allow the piston to move downward, thereby opening the ball valve. In some embodiments, the opening the ball valve may include, responsive to downward translation of the piston, shearing the shearable retaining mechanism axially fixing the seat of the ball valve in the bore, and opening the ball valve/rotating the ball of the ball valve via interaction of the camshaft with the ball.

In some embodiments, the method may further include pumping concrete downhole through the bore and open valve. In some embodiments, the method may further include attaching the sub to a deployment string (e.g. above it). In some embodiments, the method may further include removing the sub from the well after use (e.g. after pumping concrete therethrough). In some embodiments, the method may further include retrieving the sub and/or reusing the sub in another line setting operation. For example, the method may include returning the valve of the sub to the closed position and attaching the sub to another liner and/or deployment string and re-inserting it into the well. In some embodiments, returning the sub to the closed configuration may include replacing fluid in the chamber, and shifting piston upward to re-bias the piston (e.g., compressing the spring), replacing the rupture disc, placing the ball valve in the closed position, and/or securing the shearable retaining element (e.g. to fix the position of the ball seat).

In some embodiments, the method may further include biasing the piston towards the ball of the ball valve. In some embodiments, the method may further include hanging the liner from casing in well; disposing the wiper plug in the liner (e.g. below valve/sub and/or in proximity to distal/bottom/toe end of liner); running the wiper after cementing (e.g., landing the liner in wiper plug); and/or landing the liner on the landing collar. In some embodiments, the method may further include, after completion, detaching the liner from the sub/deployment string.

Figure 17:
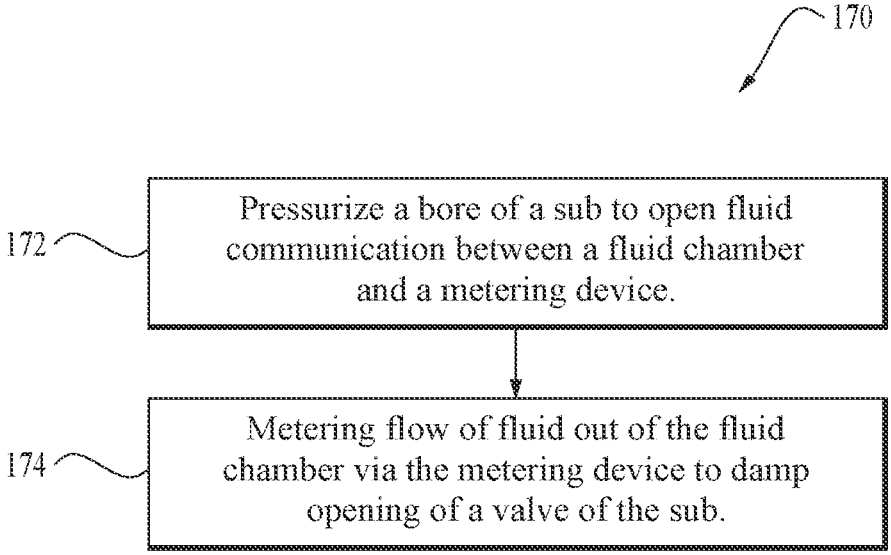
FIG. 17 is a flow diagram of an exemplary method for opening a valve of a sub, according to an embodiment.

Referring to FIG. 17, an exemplary method 170 for opening a valve in a sub disposed in a well may include in step 172 pressurizing a bore of the sub to open fluid communication between a fluid chamber and a metering device (e.g. by rupturing a rupturable element); and step 174 metering flow of fluid out of the fluid chamber via the metering device to damp opening of a valve of the sub. The sub may thus be opened in a controlled manner responsive to the fluid flow flowing through the metering device.

In some embodiments, denser fluid may be disposed in the bore above the valve and less dense fluid may be disposed in the bore below the valve. Opening the valve may include allowing flow of the denser fluid downhole through the valve in a controlled manner. In some embodiments, the controlled manner may include regulating the rate of opening and/or time for valve to open. In some embodiments, the pressurizing the bore to open fluid communication between fluid chamber and metering device may include rupturing a rupturable plug/element configured to prevent fluid communication between the fluid chamber and the metering device. In some embodiments, the opening of the valve includes, in responsive to metering flow of fluid, driving the piston downward (e.g. from closed to open position), thereby opening the valve (e.g. moving the valve from closed to open position).

In some embodiments, the piston may be held in the closed position by fluid within fluid chamber. Metering fluid out of the fluid chamber may result in the piston moving from the closed position to the open position (e.g. downward). The valve may be configured to open responsive to the piston moving from the closed position to the open position. In some embodiments, the valve may include a ball valve. Movement of the piston may shear a shearable element axially fixing/holding a seat of the ball valve and/or drive the seat downward. Downward movement of the seat may open the ball valve.

In some embodiments, downward movement of the seat opens the ball valve via a camshaft translating axial movement to rotational movement, thereby rotating a ball of the ball valve from a closed position to an open position. In the closed position a bore through the ball may not be aligned with the bore of the body of the sub, and in the open position the bore of the ball may be aligned with the bore of the body of the sub.

In some embodiments, the sub, method, and system of the present disclosure may prevent the fluid above the fluid separation sub to instantaneously drop in the area below the fluid separation sub. A flow path area may be opened up in a controlled matter, thus preventing large pressure drops and downhole surges below the fluid separation sub. After the fluid is allowed to enter the section below the fluid separation sub in a controlled matter, the sub may be fully open to allow near tubular ID type balls and plugs to be dropped. The sub can be used in the tubular section, which may be left in wellbore, or can be run in a deployed string as a retrievable tool.

ADDITIONAL DISCLOSURE

The following are non-limiting, specific embodiments in accordance with the present disclosure:

In a first embodiment, a sub/apparatus for use in a tubular string, comprising: a body having a longitudinal bore extending therethrough; a valve (such as a ball valve); a pressure activated mechanism (such as rupture disc); a fluid chamber; a piston; and a metering device; wherein: the valve comprises a (initial) closed position and an open position, wherein in the closed position the valve closes the bore (e.g. to prevent fluid flow downhole therethrough), and in the open position the valve allows fluid flow therethrough (e.g. from above the valve to below the valve); the piston comprises a first/closed position and a second/open position (e.g. corresponding to the closed/open positions of the valve); the piston is held in the first/closed position by fluid in the fluid chamber; the fluid chamber is fluidly coupled to the metering device; the pressure activated mechanism is configured to releasably seal the fluid coupling between the fluid chamber and the metering device; the pressure activated mechanism is configured to release its seal, upon application of sufficient/pre-set pressure in the bore, thereby allowing fluid in the fluid chamber to exit through the metering device; and the piston is configured to translate from its open position to its closed position, as fluid exits the fluid chamber, thereby driving the valve from its closed position to its open position.

A second embodiment can include the sub of the first embodiment, wherein a denser fluid is disposed in the bore above the closed valve and a less dense fluid is disposed in the bore below the valve.

A third embodiment can include sub of the second or first embodiments, wherein the sub includes a shearable retaining element (e.g. for the valve support sleeve); a spring (e.g.

biasing the piston towards the valve); a cam shaft; a bleeder port; one or more seals; and/or a bypass mechanism.

A fourth embodiment can include the sub of any one of the first through third embodiments, wherein the metering device meters flow of fluid to damp opening of the valve (e.g., to prevent a sudden inflow of fluid).

A fifth embodiment can include the sub of any one of the first through fourth embodiments, wherein the fluid in the fluid chamber comprises viscous fluid.

In a sixth embodiment, a system for installing a liner in a well, comprising: a sub (e.g., the sub of any one of the first through fifth embodiments); and a float-in liner, wherein denser fluid is disposed above the valve of the sub and less dense fluid is disposed below the valve, and wherein the sub valve opens in a manner allowing flow of the denser fluid therethrough while preventing large pressure drops and/or downhole surges.

A seventh embodiment can include the system of the sixth embodiment, wherein the well comprises at least a horizontal portion.

An eighth embodiment can include the system of the sixth or seventh embodiments, further comprising one or more float-in liners and/or casings in a well, a wiper plug; a wiper; a landing collar; and/or a deployment string.

In a ninth embodiment, a method for deploying/installing a liner downhole in a well, comprising: attaching a sub (e.g. the sub of any one of the first through fifth embodiments) to the liner (e.g. with the liner below the sub); separating denser fluid above the sub from less dense fluid below the sub; running the liner and sub downhole in the well, wherein the well comprises at least a portion that extends non-vertically (e.g. substantially horizontally); and applying pressure (e.g. in the bore) to actuate the sub, thereby opening a valve of the sub in a controlled/slow manner.

A tenth embodiment can include the method of the ninth embodiment, wherein the actuating comprises rupturing the pressure activated mechanism/rupturable element, thereby releasing fluid from the fluid chamber through the metering device.

An eleventh embodiment can include the method of the ninth or tenth embodiments, wherein releasing fluid through the metering device allows translation of the piston downward, thereby opening the ball valve (e.g., bore pressure acting on the piston may provide driving force on the piston, and the liquid in the chamber may support the piston (e.g., resisting downward movement), so that the downward movement depends on flow rate through the metering device).

A twelfth embodiment can include the method of any one of the ninth through eleventh embodiments, wherein opening the ball valve comprises, responsive to downward translation of the piston, shearing the shearable retaining mechanism axially fixing the seat of the ball valve in the bore, and opening the ball valve/rotating the ball of the ball valve via interaction of the camshaft with the ball. The rupture disc may rupture first, before the piston 3 can move downwards, thus placing a force on ball 2 to break the retaining device 9 (e.g., shear pin).

A thirteenth embodiment can include the method of any one of the ninth through twelfth embodiments, further comprising pumping concrete downhole through the bore and open valve.

A fourteenth embodiment can include the method of any one of the ninth through thirteenth embodiments, further comprising attaching the sub to a deployment string (e.g. above it).

A fifteenth embodiment can include the method of any one of the ninth through fourteenth embodiments, further comprising removing the sub from the well after use (e.g. after pumping concrete therethrough).

A sixteenth embodiment can include the method of any one of the ninth through fifteenth embodiments, further comprising re-using the sub (e.g., returning the sub to the closed configuration and attaching the sub to another liner and/or deployment string and re-inserting the sub into the well and/or using the sub in another well)

A seventeenth embodiment can include the method of any one of the ninth through sixteenth embodiments, wherein returning the sub to the closed configuration may include replacing fluid in the chamber (e.g., shifting the piston upward to re-bias piston (e.g., compressing spring), replacing the rupture disc, placing the ball valve in the closed position, and/or securing the shearable retaining element).

An eighteenth embodiment can include the method of any one of the ninth through seventeenth embodiments, further comprising biasing the piston towards the ball of the ball valve.

A nineteenth embodiment can include the method of any one of the ninth through eighteenth embodiments, further comprising hanging the liner from the casing in well; disposing a liner wiper plug in the liner (e.g. below the valve/sub and/or in proximity to distal/bottom/toe end of the liner); running the wiper dart after cementing and landing the wiper dart in the wiper plug; landing the wiper plug on a landing collar; and/or detaching the liner from sub/deployment string.

In a twentieth embodiment, a method for opening a valve in a sub (e.g., the sub according to any one of the first through fifth embodiments) disposed in a well, comprising: pressurizing a bore of the sub to open fluid communication between a fluid chamber and a metering device (e.g. by rupturing a rupturable element); metering a flow of fluid out of the fluid chamber via the metering device; and responsive to metering the flow of fluid, opening a valve of the sub in a controlled manner, thereby allowing fluid flow therethrough.

A twenty-first embodiment can include the method of the twentieth embodiment, wherein the method further comprises disposing denser fluid in the bore above the valve and less dense fluid in the bore below the valve.

A twenty-second embodiment can include the method of the twentieth or twenty-first embodiments, wherein opening the valve comprises allowing flow of the denser fluid downhole through the valve in a controlled manner.

A twenty-third embodiment can include the method of any one of the twentieth through twenty-second embodiments, wherein the controlled manner comprises a rate of opening and/or time for the valve to open. Time period for the valve opening may be determined by downhole conditions (e.g., hydrostatic pressure and temperature). Based upon this, viscosity of the fluid in the fluid chamber 13 and the size of the metering device 5 can be selected.

A twenty-fourth embodiment can include the method of any of the twentieth through twenty-third embodiments, wherein pressurizing the bore to open fluid communication between fluid chamber and metering device comprises rupturing a rupturable plug/element configured to prevent fluid communication between the fluid chamber and the metering device.

A twenty-fifth embodiment can include the method of any of the twentieth through twenty-fourth embodiments, wherein opening the valve comprises, responsive to metering flow of fluid, driving a piston downward (e.g. from the closed position to the open position), thereby opening the valve (e.g. moving the valve from the closed position to the open position).

A twenty-sixth embodiment can include the method of any of the twentieth through twenty-fifth embodiments, wherein the piston is held in the closed position by fluid within fluid chamber, metering fluid out of the fluid chamber results in the piston moving from closed to open position (e.g. downward), and the valve is configured to open responsive to the piston moving from the closed position to the open position.

A twenty-seventh embodiment can include the method of any one of the twentieth through twenty-sixth embodiments, wherein the valve comprises a ball valve, wherein movement of the piston shears a shearable element axially fixing/holding a seat/support of the ball valve and drives the seat downward, and wherein downward movement of the seat allows the ball valve to open.

A twenty-eighth embodiment can include the method of any one of the twentieth through twenty-seventh embodiments, wherein downward movement of the seat opens the ball valve via a camshaft translating axial movement to rotational movement, thereby rotating a ball of the ball valve from a closed position to an open position.

A twenty-ninth embodiment can include the method of any one of the twentieth through twenty-eighth embodiments, wherein when the valve is in the closed position a bore through the ball is not aligned with the bore of the body of the sub, and when the valve is in the open position the bore of the ball is aligned with the bore of the body of the sub.

In a thirtieth embodiment, a method for controlled released of pressurized fluid in a well (e.g. using a sub similar to any one of the first to fifth embodiments), the method comprising: isolating a first fluid (e.g. uphole of the valve) from a second fluid (e.g. downhole of the valve), wherein a density of the first fluid is greater than a density of the second fluid; breaking a rupture disk, in response to a pressure of the first fluid exceeding a threshold; actuating/driving a piston, in response to the breaking of the rupture disk, wherein a translational speed of the piston is regulated by a third fluid passing through an orifice metering device; and translating and rotating a ball to open a ball valve, in response to the actuation of the piston, wherein the piston exerts a force on the ball valve to cause the (e.g. axial) translation of the ball valve, wherein a control pin exerts a force on the ball valve to cause the rotation of the ball valve, and wherein the opening of the ball valve allows the first fluid to comingle with and/or displace the second fluid.

In a thirty-first embodiment, an apparatus for controlled release of pressurized fluid in a well, the apparatus comprising: a piston having an axial bore extending from a first axial end of the piston to a second axial end of the piston; a ball valve in fluid communication with the axial bore and comprising a camshaft and a lip; a control frame comprising a control pin, wherein the camshaft extends through the control frame, and the control pin contacts the lip; a casing at least partially surrounding the piston, wherein a fluid chamber configured to contain fluid is formed between the piston and the casing; a spring contacting an axial surface of the piston; an orifice metering device in fluid communication with the fluid chamber; and a rupture disk disposed at an end of the orifice metering device.

In a thirty-second embodiment, a liner system for a well, the system comprising: a deployment string extending down the well; casing at least partially surrounding the deployment string; a liner disconnect fastened to the deployment string; a liner connected to the liner disconnect; a floatation sub coupled to the deployment string; and a liner wiper attached to the floatation device; wherein the floatation device comprises a rupture disk and a ball valve (e.g. of a sub similar to any one of the first to fifth embodiments) configured to open in response to the rupture disk breaking.

In a thirty-third embodiment, a method of installing a liner, the method comprising: running a liner into a well using a deployment string, wherein at least part of the liner is horizontal, wherein the liner contains a second fluid, wherein the deployment string contains a first fluid, wherein a density of the first fluid is higher than a density of the second fluid, and wherein a floatation sub (e.g. a sub similar to any one of the first to fifth embodiments) prevents fluid communication between the deployment string and the liner when a ball valve of the floatation sub is closed; pressuring up the first fluid to break a rupture disk of the floatation sub, wherein the rupture disk causes opening of the ball valve, wherein the opening of the ball valve establishes fluid communication between the deployment string and the liner; pumping the first fluid down the liner to circulate the second fluid out of the liner; dropping a ball on a ball seat of a landing collar disposed at an end of the liner; pressuring up the first fluid to move anchoring slips against an inside diameter of the casing to secure the liner to the casing; further pressuring up the first fluid to shear the ball seat; pumping cement into the deployment string; releasing a drill pipe wiper down the deployment string; mating the drill pipe wiper with a liner wiper mounted on the deployment string to form a wiper assembly; shearing the wiper assembly from the deployment string; and deploying the wiper assembly down the liner.

In a thirty-fourth embodiment, a sub for use in a tubular string, comprising: a piston; a metering device; a body having a longitudinal bore extending therethrough; a valve, wherein when the valve is in an open position, the valve seals the bore, and wherein when the valve is in a closed position, the valve allows fluid to flow through the bore; a fluid chamber between the body and the piston; a pressure activated mechanism configured to open fluid communication between the fluid chamber and the metering device, in response to pressure in the bore exceeding a threshold, to allow fluid in the fluid chamber to exit through the metering device; and wherein the piston is configured to translate from a first position to a second position, as fluid exits the fluid chamber through the metering device, to drive the valve from the closed position to the open position.

A thirty-fifth embodiment can include the sub of the thirty-fourth embodiment, wherein when the valve is in the closed position, the valve isolates a first fluid from a second fluid, the first fluid is disposed above the valve, and the second fluid is disposed below the valve, wherein the first fluid is denser than the second fluid.

A thirty-sixth embodiment can include the sub of the thirty-fourth or thirty-fifth embodiments, wherein the piston is disposed in the bore, and a camshaft of the valve is configured to translate in a groove of a control frame as the valve rotates from the closed position to the open position.

A thirty-seventh embodiment can include the sub of any one of the thirty-fourth through thirty-sixth embodiments, wherein the pressure activated mechanism is disposed between the piston and the body.

A thirty-eighth embodiment can include the sub of any one of the thirty-fourth through thirty-seventh embodiments, further comprising a spring configured to bias the piston towards the second position.

In a thirty-ninth embodiment, a system for installing a liner in a well, comprising: a liner disconnect configured to separate a deployment string from the liner; and a sub (e.g. a sub similar to any one of the first to fifth embodiments) configured to be attached to the deployment string, the sub comprising: a metering device; a fluid chamber; a valve; a pressure activated mechanism configured to open fluid communication between the fluid chamber and the metering device, in response to pressure on the pressure activated mechanism exceeding a threshold, to allow a fluid in the fluid chamber to exit through the metering device, a piston configured to translate from a first position to a second position, as the fluid exits the fluid chamber through the metering device, to drive the valve from the closed position to the open position, to allow flow of a first fluid into the liner which contains a second fluid that is less dense than the first fluid, and wherein a rotational velocity of the valve when the valve transitions from the closed position to the open position is damped by the metering device.

A fortieth embodiment can include the system of the thirty-ninth embodiment, wherein the well comprises a vertical portion and a horizontal portion, and wherein the liner is disposed at least partially in the horizontal portion.

A forty-first embodiment can include the system of the thirty-ninth or fortieth embodiments, further comprising a liner hanger configured to secure the liner to a casing.

A forty-second embodiment can include the system of any one of the thirty-ninth through forty-first embodiments, further comprising a wiper plug configured to wipe an interior of the liner.

A forty-third embodiment can include the system of any one of the thirty-ninth through forty-second embodiments, further comprising a wiper dart configured to wipe an interior of a deployment string and latch onto the wiper plug.

In a forty-fourth embodiment, a method for installing a liner in a well, comprising: attaching a sub (e.g. a sub similar to any one of the first to fifth embodiments) to the liner; positioning a fluid of a first density in a deployment string and positioning a fluid of a second density in the liner with a valve of the sub closed such that the first fluid is isolated from the second fluid, wherein the first density is higher than the second density; running the liner and the sub downhole in the well, wherein the well comprises a horizontal portion, and wherein the liner is run at least partially into the horizontal portion; and increasing pressure of the first fluid to actuate a valve of the sub, wherein a passage of a third fluid through a metering device of the sub damps a rotational velocity of the valve as the valve transitions from a closed state to an open state to allow the first fluid to pass through the sub and into the liner.

A forty-fifth embodiment can include the method of the forty-fourth embodiment, wherein the actuating of the valve comprises rupturing a pressure activated mechanism, thereby releasing the third fluid through the metering device.

A forty-sixth embodiment can include the method of the forty-fourth or forty-fifth embodiments, wherein a spring of the sub and/or pressure in the bore drives a piston of the sub downward/downhole which translates the valve along an axis of the sub, and a control pin disposed off-center with respect to a rotational axis of the valve drives the valve to rotate to open as the valve translates.

A forty-seventh embodiment can include the method of any one of the forty-fourth through forty-sixth embodiments, further comprising pumping concrete downhole after the opening of the valve.

A forty-eighth embodiment can include the method of any one of the forty-fourth through forty-seventh embodiments, further comprising removing the sub from the well after the pumping of the concrete.

In a forty-ninth embodiment, a method for opening a valve in a sub disposed in a well, comprising: pressurizing a bore of the sub (e.g. of a sub similar to any one of the first to fifth embodiments) to open fluid communication between a fluid chamber and a metering device; metering flow of fluid out of the fluid chamber via the metering device; and transitioning the valve from a closed position to an open position, wherein the metering of the flow of fluid damps a velocity of the valve as the valve transitions from the closed position to the open position.

A fiftieth embodiment can include the method of the forty-ninth embodiment, wherein a time for the valve to transition from the closed position to the open position is at least five minutes.

A fifty-first embodiment can include the method of the forty-ninth or fiftieth embodiments, wherein a flow rate of the flow of fluid limits the rotational velocity of the valve.

A fifty-second embodiment can include the method of any one of the forty-ninth through fifty-first embodiments, further comprising exerting a force on a piston by a spring and/or bore pressure to axially translate the piston to drive the valve to transition from the closed position to the open position.

A fifty-third embodiment can include the method of any one of the forty-ninth through fifty-second embodiments, wherein the (e.g. axial) translating of the piston shears a shearing device of the sub.

In a fifty-fourth embodiment, an apparatus for use in a tubular string, comprising: a piston having a bore extending therethrough; a metering device having a fluid passageway formed therein, wherein a pressure activated mechanism is configured to block the fluid passageway; a body having a longitudinal bore extending therethrough, wherein the piston is disposed inside the body; a shearing device releasably fixing the piston to the body, a fluid chamber formed between the piston and the body, wherein the metering device is formed between the piston and the body adjacent to the fluid chamber; a spring disposed in a spring chamber between the piston and the body, wherein the metering device is disposed between the fluid chamber and the spring chamber, wherein the spring abuts the metering device and abuts an axial surface of the piston; a valve comprising a ball disposed in the piston and comprising an open position and a closed position, wherein the ball comprises a camshaft extending through a groove of a control frame, wherein the control frame is disposed inside the body and comprises a control pin configured to contact a lip of the ball, wherein the control frame is spaced apart from the metering device, wherein a bleeder port is formed in the body and extends from the spring chamber to an exterior of the body, wherein in the open position the valve seals the bore, and in the closed position the valve allows fluid to flow through the bore, wherein the pressure activated mechanism is configured to open fluid communication between the fluid chamber and the metering device, in response to pressure in the bore exceeding a threshold, to allow fluid in the fluid chamber to exit through the metering device, wherein the piston is configured to translate from a first position to a second position, as fluid exits the fluid chamber through the metering device, to drive the valve from the closed position to the open position.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=R1+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either element from the set {A, B}, including multiples of any either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the terms "a" and "an" mean "one or more." As used herein, the term "the" means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for installing a liner in a well, comprising:

a liner disconnect configured to separate a deployment string from the liner; and an apparatus configured to be attached to the deployment string, the apparatus comprising:

a metering device;

a fluid chamber;

a valve;

a pressure activated mechanism configured to open fluid communication between the fluid chamber and the metering device, in response to pressure on the pressure activated mechanism exceeding a threshold, to allow a first fluid in the fluid chamber to exit through the metering device; and a piston configured to translate from a first position to a second position, as the first fluid exits the fluid chamber through the metering device, to drive the valve from a closed position to an open position, to allow flow of a second fluid into the liner which contains a third fluid that is less dense than the second fluid, wherein the metering device is configured to damp a velocity of the valve transitioning from the closed position to the open position.

2. The system of claim 1, wherein the well comprises a vertical portion and a horizontal portion, and wherein the liner is disposed at least partially in the horizontal portion.

3. The system of claim 1, further comprising a liner hanger configured to secure the liner to a casing or to another liner.

4. The system of claim 1, further comprising a wiper plug configured to wipe an interior of the liner.

5. The system of claim 4, further comprising a wiper dart configured to wipe an interior of a deployment string and latch onto the wiper plug.

6. The system of claim 1, wherein the apparatus further comprising a body having a longitudinal bore extending therethrough.

7. The system of claim 6, wherein the valve further comprises a ball valve having a ball support, and the apparatus further comprises a shearable retaining element configured to axially fix the ball support in the body.

8. The system of claim 7, wherein the valve comprises a camshaft configured to translate in a groove of a control frame as the valve rotates from the closed position to the open position.

9. The system of claim 8, wherein the well comprises a vertical portion and a horizontal portion, and wherein the liner is disposed at least partially in the horizontal portion.

10. The system of claim 8, further comprising a liner hanger configured to secure the liner to a casing or to another liner.

11. The system of claim 8, further comprising a wiper plug configured to wipe an interior of the liner, and a wiper dart configured to wipe an interior of a deployment string and latch onto the wiper plug.

12. The system of claim 7, wherein the well comprises a vertical portion and a horizontal portion, and wherein the liner is disposed at least partially in the horizontal portion.

13. The system of claim 7, further comprising a liner hanger configured to secure the liner to a casing or to another liner.

14. The system of claim 7, further comprising a wiper plug configured to wipe an interior of the liner.

15. The system of claim 14, further comprising a wiper dart configured to wipe an interior of a deployment string and latch onto the wiper plug.

16. The system of claim 6, wherein the well comprises a vertical portion and a horizontal portion, and wherein the liner is disposed at least partially in the horizontal portion.

17. The system of claim 6, further comprising a liner hanger configured to secure the liner to a casing or to another liner.

18. The system of claim 6, further comprising a wiper plug configured to wipe an interior of the liner.

19. The system of claim 18, further comprising a wiper dart configured to wipe an interior of a deployment string and latch onto the wiper plug.

20. The system of claim 1, wherein the apparatus further comprises a spring configured to bias the piston towards the second position.

* * * * *